US005719007A

United States Patent [19]

Sakurazawa et al.

[11] Patent Number: 5,719,007

[45] Date of Patent: Feb. 17, 1998

[54] SILVER HALIDE COLOR PHOTOGRAPHIC MATERIAL

[75] Inventors: Mamoru Sakurazawa; Hisashi Mikoshiba; Masakazu Morigaki, all of Kanagawa, Japan

[73] Assignee: Fuji Photo Film Co., Ltd., Kanagawa, Japan

[21] Appl. No.: 593,455

[22] Filed: Jan. 29, 1996

[30] Foreign Application Priority Data

Jan. 30, 1995 [JP] Japan ..... 7-031807

[51] Int. Cl.[6] ..... G03C 1/06

[52] U.S. Cl. ..... 430/264; 430/598; 430/600; 430/613; 430/614; 430/615; 430/623; 430/626; 430/523; 430/551

[58] Field of Search ..... 430/264, 598, 430/503, 600, 613, 614, 615, 623, 626, 523, 551, 505

[56] References Cited

U.S. PATENT DOCUMENTS

| | | | |
|---|---|---|---|
| 3,905,821 | 9/1975 | Ohtani et al. | 430/600 |
| 3,960,568 | 6/1976 | Sueyoshi et al. | 430/630 |
| 4,054,458 | 10/1977 | Ohtani et al. | 430/600 |
| 4,680,257 | 7/1987 | Sato et al. | 430/614 |
| 4,923,787 | 5/1990 | Harder | 430/489 |
| 5,230,992 | 7/1993 | Miyahashi et al. | 430/505 |
| 5,563,025 | 10/1996 | Ishii et al. | 430/615 |

FOREIGN PATENT DOCUMENTS

| | | |
|---|---|---|
| 4365032 | 12/1992 | Japan . |
| 6011791 | 1/1994 | Japan . |

*Primary Examiner*—Geraldine Letscher
*Attorney, Agent, or Firm*—Sughrue, Mion, Zinn, Macpeak & Seas, PLLC

[57] ABSTRACT

A silver halide color photographic material is described, which comprises a support having thereon at least one blue-sensitive silver halide emulsion layer, at least one green-sensitive silver halide emulsion layer, at least one red-sensitive silver halide emulsion layer and at least one light-insensitive layer, wherein one or more of the above layers contains at least one compound represented by formula (A-I), (A-II), (A-III), (A-IV) or (A-V) and one or more of the above layers contains at least one compound represented by formula (H):

(A-I)

(A-II)

(A-III)

(A-IV)

(A-V)

(H)

10 Claims, No Drawings

SILVER HALIDE COLOR PHOTOGRAPHIC MATERIAL

FIELD OF THE INVENTION

The present invention relates to a silver halide color photographic material and, in particular, to a silver halide color photographic material which is excellent in pressure resistance, increases less fog after storage and generates less fluctuation in photographic characteristics after photographing until development processing.

BACKGROUND OF THE INVENTION

In a silver halide color photographic material, in particular, in a material for photographing, it is required, as well as high sensitivity, that fluctuations in photographic characteristics are less during storage after manufacture of a photographic material until exposure and also after photographing until development processing.

Further, it is also required that a fluctuation in photographic characteristics is less when a pressure is applied to the surface of a photographic material in a camera or during development processing.

With respect to the fluctuation in photographic characteristics after photographing until development processing, that is, with respect to the storage stability of a latent image, an improving method by the combined use of a triazine based compound with a hardening agent having an active vinyl group is disclosed, for example, in JP-A-59- 162546 (the term "JP-A" as used herein means an "unexamined published Japanese patent application").

The effect of prevention of latensification can be seen by this method, but its effect is still in a level of further improvement being required, and the storage stability of a photographic material is much the same.

In a silver halide color photographic material, it is well known that if the oxidized product of a developing agent diffuses into different spectral sensitive layers and colors therein, undesired color turbidity (color mixing between layers) is generated and it adversely affects color reproducibility.

As a means to prevent such a phenomenon, it is generally conducted to add a compound which reduces the oxidized product of a developing agent. There are proposed, for example, the methods using hydroquinone based compounds in U.S. Pat. Nos. 2,728,659 and 4,277,553, the methods using hydroquinones which incorporate substituents for improving the ability of preventing color mixing in U.S. Pat. No. 4,198,239 and JP-A-59-202465, and the methods using hydrazine based compounds in JP-A-1-147455.

The present inventors have found that the above described hydroquinone compounds generate hydrogen peroxide in a gelatin layer with the lapse of time and it concerns the fluctuation in photographic characteristics during storage of a photographic material. On the contrary, with the hydrazine compounds, the generation of hydrogen peroxide is moderate and the influence on the fluctuation in photographic characteristics is reduced but the fluctuation in photographic characteristics after photographing until development processing is still insufficient.

Further, when a photographic material having a magnetic recording layer is put in a film cartridge and aged as it is, the fluctuation in photographic characteristics has been sometimes still further deteriorated.

Various pressures are applied to a silver halide color photographic material, in particular, a photographic material for photographing (for example, pressure is applied to a negative film for general photography at times by packing the film into a patrone or by frame sliding when loading a film into a camera) and the pressure resistance in such cases is also required.

In the specification of the above JP-A-59-162546, there is no description with respect to improving the pressure resistance using triazine based compounds.

SUMMARY OF THE INVENTION

Accordingly, an object of the present invention is to provide a silver halide color photographic material which is excellent in pressure resistance, increases less fog after storage and generates less fluctuation in photographic characteristics after photographing until development processing.

The present inventors have been engaged in studies to develop the silver halide color photographic material which meets the above object. As a result, the above object of the present invention has been achieved by the following silver halide color photographic material. That is, (1) A silver halide color photographic material comprising a support having thereon at least one blue-sensitive silver halide emulsion layer, at least one green-sensitive silver halide emulsion layer, at least one red-sensitive silver halide emulsion layer and at least one light-insensitive layer, wherein one or more of the above layers contain at least one compound represented by formula (A-I), (A-II), (A-III), (A-IV) or (A-V) and one or more of the above layers contain at least one compound represented by formula (H):

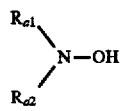
(A-I)

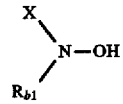
(A-II)

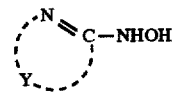
(A-III)

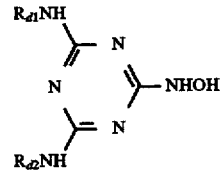
(A-IV)

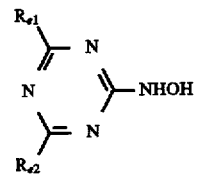
(A-V)

In formula (A-I), $R_{a1}$ represents an alkyl group, an alkenyl group, an aryl group, an acyl group, an alkylsulfonyl group, an arylsulfonyl group, an alkylsulfinyl group, an arylsulfinyl group, a carbamoyl group, a sulfamoyl group, an alkoxycarbonyl group, or an aryloxycarbonyl group; $R_{a2}$ represents a hydrogen atom or a substituent described for $R_{a1}$, provided that when $R_{a1}$ represents an alkyl group, an alkenyl group or an aryl group, $R_{a2}$ represents an acyl group, an alkylsulfonyl group, an arylsulfonyl group, an alkylsulfinyl group, an arylsulfinyl group, a carbamoyl group, a sulfamoyl group, an alkoxycarbonyl group or an aryloxycarbonyl group, and $R_{a1}$ and $R_{a2}$ may be bonded with each other to form a 5- to 7-membered ring;

In formula (A-II), X represents a heterocyclic group; $R_{b1}$ represents an alkyl group, an alkenyl group or an aryl group, and X and $R_{b1}$ may be bonded with each other to form a 5- to 7-membered ring;

In formula (A-III), Y represents a nonmetallic atomic group necessary to form a 5-membered ring together with an —N=C— group, Y further represents a nonmetallic atomic group necessary to form a 6-membered ring together with an —N=C— group, and the terminal of Y bonded to the carbon atom of an —N=C— group represents a group selected from the group consisting of $—N(R_{c1})—$, $—C(R_{c2})(R_{c3})—$, $—C(R_{c4})=$, —O— and —S— (bonded to the carbon atom of an —N=C— group at the left side of each group); $R_{c1}$, $R_{c2}$, $R_{c3}$ and $R_{c4}$ each represents a hydrogen atom or a substituent;

In formula (A-IV), $R_{d1}$ and $R_{d2}$, which may be the same or different, each represents an alkyl group or an aryl group, provided that when $R_{d1}$ and $R_{d2}$ represent unsubstituted alkyl groups at the same time and yet $R_{d1}$ and $R_{d2}$ represent the same substituents, $R_{d1}$ and $R_{d2}$ represent an alkyl group having 8 or more carbon atoms;

In formula (A-V), $R_{e1}$ and $R_{e2}$, which may be the same or different, each represents a hydroxylamino group, a hydroxyl group, an amino group, an alkylamino group, an arylamino group, an alkoxyl group, an aryloxy group, an alkylthio group, an arylthio group, an alkyl group or an aryl group, provided that $R_{e1}$ and $R_{e2}$ do not represent $—NHR_{e3}$ (where $R_{e3}$ represents an alkyl group or an aryl group) at the same time;

$$X—\underset{\underset{R^5}{|}}{N}(G)_m—R^2 \qquad \text{(H)}$$

wherein X represents $—N(R^1)R^3$, where $R^1$ represents a hydrogen atom, an aliphatic group, an aromatic group or a heterocyclic group, and $R^3$ represents a hydrogen atom or a group removed off under an alkaline condition; $R^2$ represents a hydrogen atom, an aliphatic group, an aromatic group, a heterocyclic group, a cyano group, a nitro group or a hydrazino group; X and $R^2$ may be linked to form a ring; $R^5$ represents a hydrogen atom, an alkyl group or a group removed off under an alkaline condition; two or more of formula (H) may be bonded at the $R^1$, $R^2$ or $R^5$ part to form an oligomer or polymer; G represents —CO—, —COCO—, $—SO_2—$, —SO—, $—CON(R^6)—$, —COO—, $—COCON(R^7)—$, —COCOO—, $—PO(R^8)—$, $—PO(R^8)O—$, —CS— or an iminomethylene group, where $R^6$ and $R^7$ represent a hydrogen atom, an alkyl group or an aryl group, and $R^8$ represents an alkyl group, an aryl group, an alkoxyl group or an aryloxy group; and m is 0, 1 or 2, and when m is 2, G may be the same or different.

(2) The silver halide color photographic material as described in (1), wherein a magnetic layer containing a ferromagnetic powder is provided on the opposite side of the support on which the light-sensitive emulsion layer is provided.

The present inventors have found that oxygen is concerned with one of the causes of the fluctuations in photographic characteristics due to storage of a photographic material and also after photographing until development processing.

It is presumed that any of the compounds in a photographic material reacts with oxygen and affects photographic characteristics but the compounds represented by formula (A-I), (A-II), (A-III), (A-IV) or (A-V) capture organic radicals which are produced by the reaction with oxygen.

DETAILED DESCRIPTION OF THE INVENTION

The present invention will be described in detail below.

The compounds represented by formula (A-I), (A-II), (A-III), (A-IV) or (A-V) will be explained further in detail below.

The alkyl group used in the present invention is a straight chain, branched or cyclic alkyl group which may have a substituent.

As such a substituent, there can be cited, e.g., an alkyl group, an alkenyl group, an aryl group, a heterocyclic group, a hydroxyl group, an alkoxyl group, an aryloxy group, an alkylthio group, an arylthio group, an amino group, an acylamino group, a sulfonamido group, an alkylamino group, an arylamino group, a carbamoyl group, a sulfamoyl group, a sulfo group, a carboxyl group, a halogen atom, a cyano group, a nitro group, a sulfonyl group, an acyl group, an alkoxy-carbonyl group, an aryloxycarbonyl group, an acyloxy group, or a hydroxyamino group.

In formula (A-I), $R_{a1}$ represents an alkyl group (preferably an alkyl group having from 1 to 36 carbon atoms, e.g., methyl, ethyl, i-propyl, cyclopropyl, butyl, isobutyl, cyclohexyl, t-octyl, decyl, dodecyl, hexadecyl, benzyl), an alkenyl group (preferably an alkenyl group having from 2 to 36 carbon atoms, e.g., allyl, 2-butenyl, isopropenyl, oleyl, vinyl), an aryl group (preferably an aryl group having from 6 to 40 carbon atoms, e.g., phenyl, naphthyl), an acyl group (preferably an acyl group having from 2 to 36 carbon atoms, e.g., acetyl, benzoyl, pivaloyl, α-(2,4-di-tert-amylphenoxy)-butyryl, myristoyl, stearoyl, naphthoyl, m-pentadecylbenzoyl, isonicotinoyl), an alkyl- or arylsulfonyl group (preferably an alkyl- or arylsulfonyl group having from 1 to 36 carbon atoms, e.g., methanesulfonyl, octanesulfonyl, benzenesulfonyl, toluenesulfonyl), an alkyl- or arylsulfinyl group (preferably an alkyl- or arylsulfinyl group having from 1 to 40 carbon atoms, e.g., methanesulfinyl, benzenesulfinyl), a carbamoyl group (including an N-substituted carbamoyl group and preferably a carbamoyl group having from 0 to 40 carbon atoms, e.g., N-ethylcarbamoyl, N-phenylcarbamoyl, N,N-dimethylcarbamoyl, N-butyl-N-phenylcarbamoyl), a sulfamoyl group (including an N-substituted sulfamoyl group and preferably a sulfamoyl group having from 1 to 40 carbon atoms, e.g., N-methylsulfamoyl, N,N-diethylsulfamoyl, N-phenylsulfamoyl, N-cyclohexyl-N-phenylsulfamoyl, N-ethyl-N-dodecylsulfamoyl), an alkoxycarbonyl group (preferably an alkoxycarbonyl group having from 2 to 36 carbon atoms, e.g., methoxycarbonyl, cyclohexyloxycarbonyl, benzyloxycarbonyl, isoamyloxycarbonyl, hexadecyloxycarbonyl), or an aryloxycarbonyl group (preferably an aryloxycarbonyl group having from 7 to 40 carbon atoms, e.g., phenoxycarbonyl, naphthoxycarbonyl). $R_{a2}$ represents a hydrogen atom or a substituent described for $R_{a1}$.

In formula (A-II), X represents a heterocyclic group (a 5- to 7-membered heterocyclic group having at least one of a nitrogen atom, a sulfur atom, an oxygen atom or a phosphorus atom as a cyclic constitutional atom, and the bonding position of a heterocyclic ring (the position of a monovalent group) being preferably a carbon atom, e.g., 1,3,5-triazin-2-yl, 1,2,4-triazin-3-yl, pyridin-2-yl, pyrazinyl, pyrimidinyl, purinyl, quinolyl, imidazolyl, 1,2,4-triazol-3-yl, benzimidazol-2-yl, thienyl, furyl, imidazolidinyl, pyrrolinyl, tetrahydrofuryl, morpholinyl, phosphinolin-2-yl). $R_{b1}$ represents an alkyl group, an alkenyl group or an aryl group having the same meaning as $R_{a1}$ in formula (A-I).

In formula (A-III), Y represents a nonmetallic atomic group necessary to form a 5-membered ring together with an —N=C— group (e.g., a ring group to be formed being imidazolyl, benzimidazolyl, 1,3-thiazol-2-yl, 2-imidazolin-2-yl, purinyl, 3H-indol-2-yl). Y further represents a nonmetallic atomic group necessary to form a 6-membered ring together with an —N=C— group, and the terminal of Y bonded to the carbon atom of an —N=C— group represents a group selected from the group consisting of —N($R_{c1}$)—, —C($R_{c2}$)($R_{c3}$)—, —C($R_{c4}$)=, —O— and —S— (which is bonded to the carbon atom of an —N=C— group at the left side of each group). $R_{c1}$, $R_{c2}$, $R_{c3}$ and $R_{c4}$, which may be the same or different, each represents a hydrogen atom or a substituent (e.g., an alkyl group, an alkenyl group, an aryl group, an alkoxyl group, an aryloxy group, an alkylthio group, an arylthio group, an alkylamino group, an arylamino group, a halogen atom). 6-Membered ring groups formed by Y include, for example, quinolyl, isoquinolyl, phthalazinyl, quinoxalinyl, 1,3,5-triazin-5-yl and 6H-1,2,5-thiadiazin-6-yl.

In formula (A-IV), $R_{d1}$ and $R_{d2}$ each represents an alkyl group (preferably an alkyl group having from 1 to 36 carbon atoms, e.g., methyl, ethyl, i-propyl, cyclopropyl, n-butyl, isobutyl, hexyl, cyclohexyl, t-octyl, decyl, dodecyl, hexadecyl, benzyl) or an aryl group (preferably an aryl group having from 6 to 40 carbon atoms, e.g., phenyl, naphthyl), provided that when $R_{d1}$ and $R_{d2}$ represent unsubstituted alkyl groups at the same time and yet $R_{d1}$ and $R_{d2}$ represent the same substituents, $R_{d1}$ and $R_{d2}$ represent an alkyl group having 8 or more carbon atoms.

In formula (A-V), $R_{e1}$ and $R_{e2}$ each represents a hydroxylamino group, a hydroxyl group, an amino group, an alkylamino group (preferably an alkylamino group having from 1 to 50 carbon atoms, e.g., methylamino, ethylamino, diethylamino, methylethylamino, propylamino, dibutylamino, cyclohexylamino, t-octylamino, dodecylamino, hexadecylamino, benzylamino, benzylbutylamino), an arylamino group (preferably an arylamino group having from 6 to 50 carbon atoms, e.g., phenylamino, phenylmethylamino, diphenylamino, naphthylamino), an alkoxyl group (preferably an alkoxyl group having from 1 to 36 carbon atoms, e.g., methoxy, ethoxy, butoxy, t-butoxy, cyclohexyloxy, benzyloxy, octyloxy, tridecyloxy, hexadecyloxy), an aryloxy group (preferably an aryloxy group having from 6 to 40 carbon atoms, e.g., phenoxy, naphthoxy), an alkylthio group (preferably an alkylthio group having from 1 to 36 carbon atoms, e.g., methylthio, ethylthio, i-propylthio, butylthio, cyclohexylthio, benzylthio, t-octylthio, dodecylthio), an arylthio group (preferably an arylthio group having from 6 to 40 carbon atoms, e.g., phenylthio, naphthylthio), an alkyl group (preferably an alkyl group having from 1 to 36 carbon atoms, e.g., methyl, ethyl, propyl, butyl, cyclohexyl, i-amyl, sec-hexyl, t-octyl, dodecyl, hexadecyl) or an aryl group (preferably an aryl group having from 6 to 40 carbon atoms, e.g., phenyl, naphthyl), provided that $R_{e1}$ and $R_{e2}$ do not represent —NH$R_{e3}$ (where $R_{e3}$ represents an alkyl group or an aryl group) at the same time.

$R_{a1}$ and $R_{a2}$, and X and $R_{b1}$ may be bonded with each other to form a 5- to 7-membered ring, e.g., a succinimido ring, a phthalimido ring, a triazole ring, a urazol ring, a hydantoin ring or a 2-oxo-4-oxazolidinone ring.

Each group of the compounds represented by formula (A-I), (A-II), (A-III), (A-IV) or (A-V) may further be substituted with a substituent.

As such a substituent, there can be cited, e.g., an alkyl group, an alkenyl group, an aryl group, a heterocyclic group, a hydroxyl group, an alkoxyl group, an aryloxy group, an alkylthio group, an arylthio group, an amino group, an acylamino group, a sulfonamido group, an alkylamino group, an arylamino group, a carbamoyl group, a sulfamoyl group, a sulfo group, a carboxyl group, a halogen atom, a cyano group, a nitro group, a sulfonyl group, an acyl group, an alkoxycarbonyl group, an aryloxycarbonyl group, an acyloxy group, or a hydroxyamino group.

In formula (A-I), preferably $R_{a2}$ represents a hydrogen atom, an alkyl group, an alkenyl group, or an aryl group and $R_{a1}$ represents an acyl group, a sulfonyl group, a sulfinyl group, a carbamoyl group, a sulfamoyl group, an alkoxycarbonyl group, or an aryloxycarbonyl group, more preferably $R_{a2}$ represents an alkyl group or an alkenyl group and $R_{a1}$ represents an acyl group, a sulfonyl group, a carbamoyl group, a sulfamoyl group, an alkoxycarbonyl group, or an aryloxycarbonyl group, and most preferably $R_{a2}$ represents an alkyl group and $R_{a1}$ represents an acyl group.

In formula (A-II), $R_{b1}$ preferably represents an alkyl group or an alkenyl group, more preferably an alkyl group. Formula (A-II) is preferably represented by formula (A-II-1), more preferably X represents 1,3,5-triazin-2-yl, and most preferably represented by formula (A-II-2).

(A-II-1)

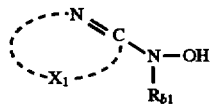

wherein $R_{b1}$ has the same meaning as $R_{b1}$ in formula (A-II) and $X_1$ represents a nonmetallic atomic group necessary to form a 5- or 6-membered ring.

Of the compounds represented by formula (A-II-1), the case where $X_1$ forms a 5- or 6-membered hetero aromatic ring is more preferred.

(A-II-2)

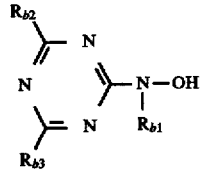

wherein $R_{b1}$ has the same meaning as $R_{b1}$ in formula (A-II); and $R_{b2}$ and $R_{b3}$, which may be the same or different, each represents a hydrogen atom or a substituent.

As such a substituent, there can be cited, e.g., an alkyl group, an alkenyl group, an aryl group, a heterocyclic group, a hydroxyl group, an alkoxyl group, an aryloxy group, an alkylthio group, an arylthio group, an amino group, an acylamino group, a sulfonamido group, an alkylamino group, an arylamino group, a carbamoyl group, a sulfamoyl group, a sulfo group, a carboxyl group, a halogen atom, a cyano group, a nitro group, a sulfonyl group, an acyl group, an alkoxycarbonyl group, an aryloxycarbonyl group, an acyloxy group, or a hydroxyamino group.

Of the compounds represented by formula (A-II-2), the case where $R_{b2}$ and $R_{b3}$ each represents a hydroxylamino group, a hydroxyl group, an amino group, an alkylamino group, an arylamino group, an alkoxyl group, an aryloxy group, an alkylthio group, an arylthio group, an alkyl group or an aryl group is particularly preferred.

Of the compounds represented by formula (A-III), the case where Y represents a nonmetallic atomic group necessary to form a 5-membered ring is preferred and the case where the terminal of Y bonded to the carbon atom of an —N=C— group is a nitrogen atom is more preferred.

The case where Y forms an imidazoline ring is most preferred. This imidazoline ring may be condensed with a benzene ring.

Of the compounds represented by formula (A-IV), and $R_{d2}$ each preferably represents an alkyl group.

On the other hand, in formula (A-V), $R_{e1}$ and $R_{e2}$ each preferably represents a hydroxylamino group, an alkylamino group or an alkoxyl group, particularly preferably represents a hydroxylamino group and $R_{e2}$ represents an alkylamino group.

Of the compounds represented by formula (A-I), (A-II), (A-III), (A-IV) or (A-V), the compounds whose sum total of the carbon atom number is 15 or less is preferred in view of functioning also to layers other than the layer to which the compound is added, on the contrary, the compounds whose sum total of the carbon atom number is 16 or more is preferred for functioning only in the layer to which the compound is added.

Of the compounds represented by formula (A-I), (A-II), (A-III), (A-IV) or (A-V), the compounds represented by formula (A-I), (A-II), (A-IV) or (A-V) are preferred, those represented by formula (A-I), (A-IV) or (A-V) are more preferred, and those represented by formula (A-I) or (A-V) are still more preferred.

Specific examples of the compounds represented by formula (A-I), (A-II), (A-III), (A-IV) or (A-V) are shown below but the present invention is not limited thereto.

A-1

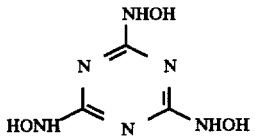

A-2

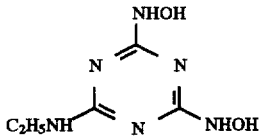

A-3

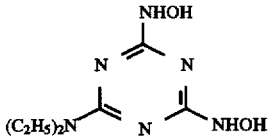

A-4

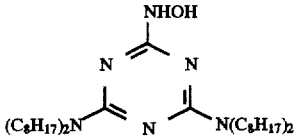

A-5

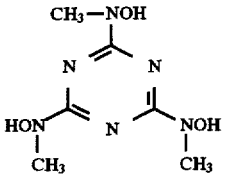

A-6

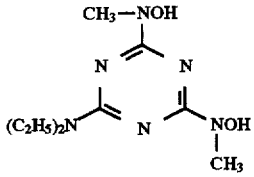

A-7

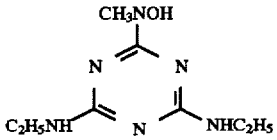

A-8

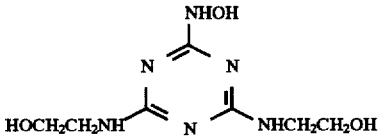

A-9

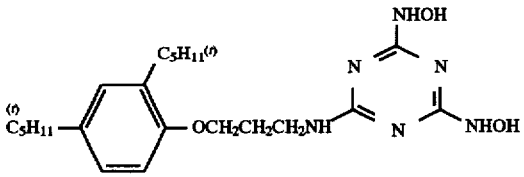

A-10

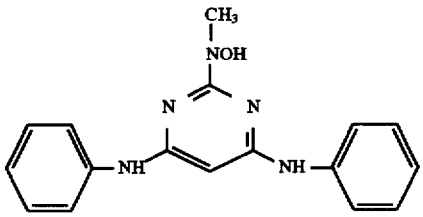

A-11

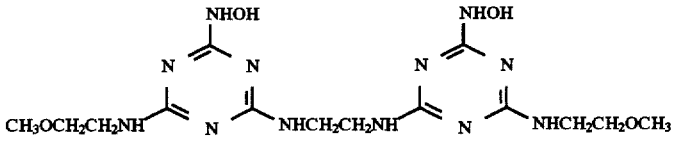

A-12

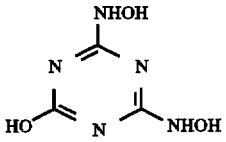

A-13

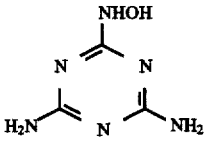

-continued
A-14
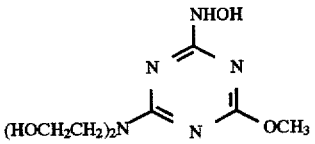
A-15
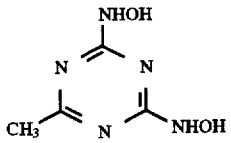
A-16
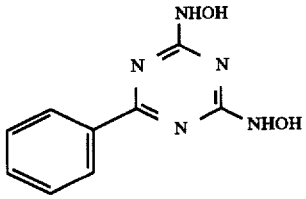
A-17
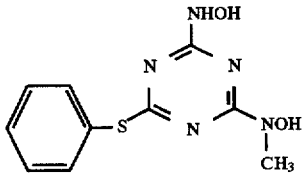
A-18
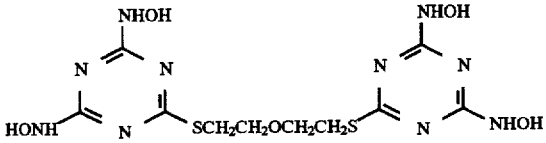
A-19
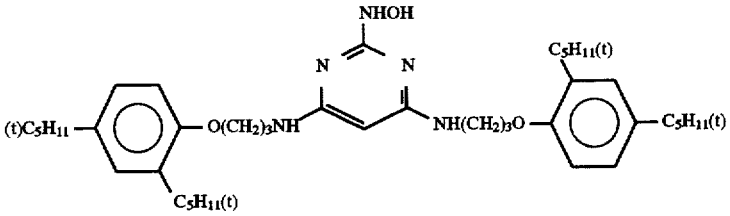
A-20
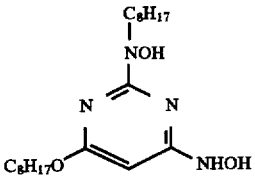
A-21
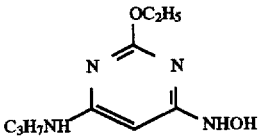
A-22
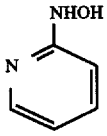
A-23
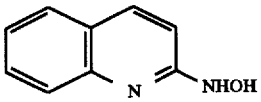
A-24
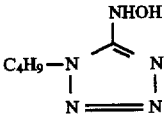
A-25
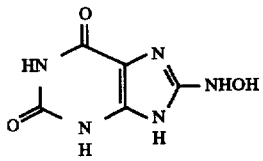
A-26
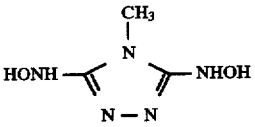
A-27
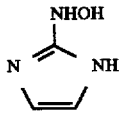
A-28
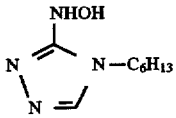
A-29
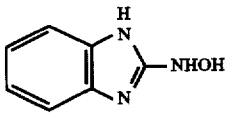
A-30
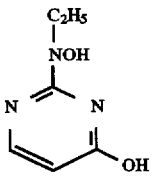
A-31
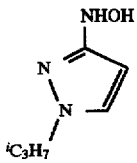

-continued
A-32
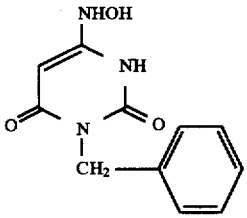
A-33
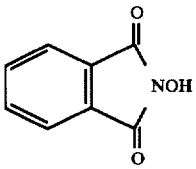
A-34
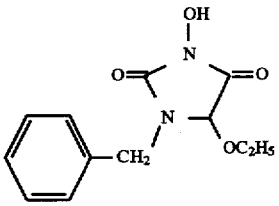
A-35
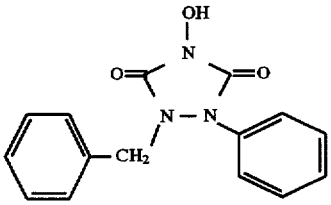
A-36
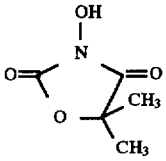
A-37
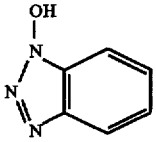
A-38
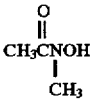
A-39
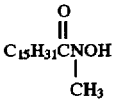
A-40
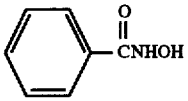
A-41
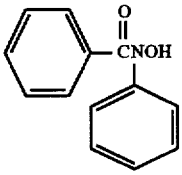
A-42
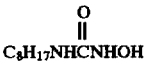
A-43
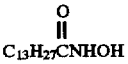
A-44
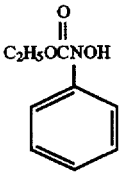
A-45
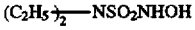
A-46
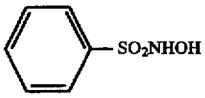
A-47
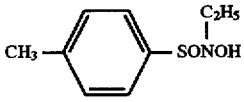
A-48
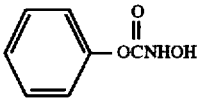
A-49
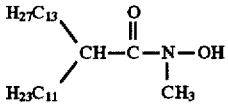
A-50
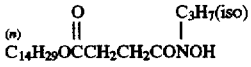
A-51
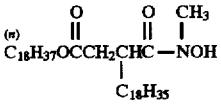
A-52
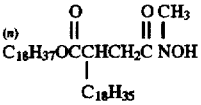
A-53
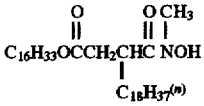

-continued

A-54

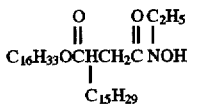

A-55

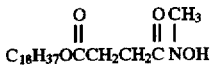

A-56

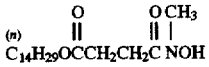

A-57

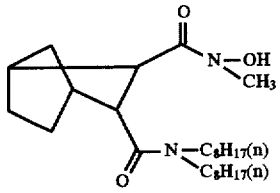

A-58

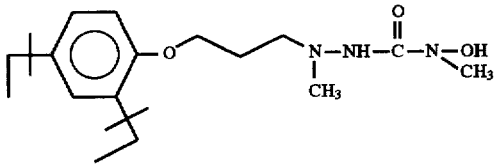

A-59

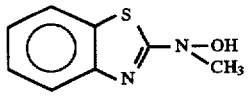

A-60

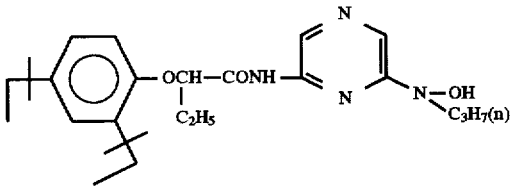

A-61

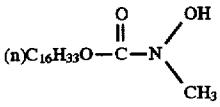

A-62

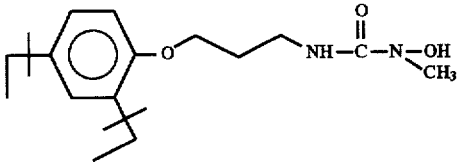

A-63

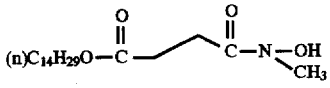

A-64

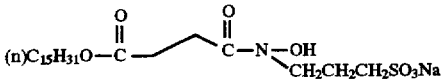

A-65

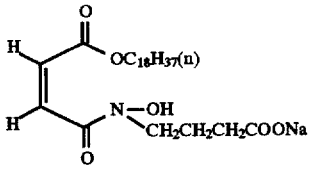

A-66

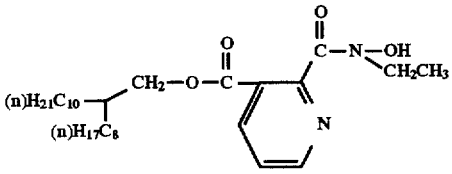

A-67

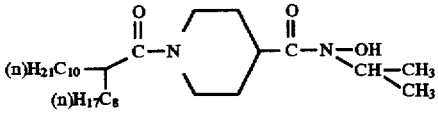

The correspondences of these compounds with formula (A-I), (A-II), (A-III), (A-IV) or (A-V) are as follows. Formula (A-I): Compounds A-33 to A-55 Formula (A-II): Compounds A-5 to A-7, A-10, A-20 and A-30 Formula (A-III): Compounds A-21 to A-29, A-31 and A-32 Formula (A-IV): Compounds A-8, A-11 and A-19 Formula (A-V): Compounds A-1 to A-4, A-9, A-12 to A-18

These compounds of the present invention can be easily synthesized according to the methods disclosed in *J. Org. Chem.*, 27, 4054 (1962), *J. Amer. Chem. Soc.*, 73, 2981 (1951) and JP-B-49-10692 (the term "JP-B" as used herein means an "examined Japanese patent publication") or corresponding methods thereto.

In the present invention, the compounds represented by formula (A-I), (A-II), (A-III), (A-IV) or (A-V) may be added to an emulsion by dissolving in water, a water-soluble solvent such as methanol and ethanol or a mixed solvent of them, or may be added in the form of an emulsifying dispersion. Further, they may be added previously at the time of preparation of an emulsion.

When the compounds are dissolved in water, if the solubility is increased with high pH or low pH, they may be dissolved with raising or lowering pH.

In the present invention, the compounds represented by formula (A-I), (A-II), (A-III), (A-IV) or (A-V) may be used in combination of two or more.

For instance, a water-soluble compound and an oil-soluble compound are advantageously used in combination from the viewpoint of photographic performance.

The coating amount of the compounds represented by formula (A-I), (A-II), (A-III), (A-IV) or (A-V) is preferably from $10^{-4}$ mmol/m$^2$ to 10 mmol/m$^2$, more preferably from $10^{-3}$ mmol/m$^2$ to 1 mmol/m$^2$, and they can be added to either a light-sensitive emulsion layer or a light-insensitive layer.

"A light-insensitive layer" used in the present invention means a hydrophilic colloid layer not containing a light-sensitive silver halide emulsion, for example, a layer in relationship of water permeability with a light-sensitive silver halide emulsion layer such as a protective layer, an interlayer (a color mixing preventing layer), or an antihalation layer.

Further, a blue-sensitive silver halide emulsion layer, a green-sensitive silver halide emulsion layer and a red-sensitive silver halide emulsion layer are well known in the art, and each layer may comprise two or more layers of the same spectral sensitivity but different degrees of sensitivity.

The compound represented by formula (H) is explained in further detail below.

The aliphatic group represented by $R^1$ or $R^2$ is a straight chain, branched or cyclic alkyl group having from 1 to 30 carbon atoms, an aralkyl group, an alkenyl group or an alkynyl group. The alkyl group is a straight chain, branched chain or cyclic alkyl group having from 1 to 30 carbon atoms, e.g., methyl, cyclohexyl, 2-octyl or octadecyl. The aralkyl group has from 7 to 30 carbon atoms, e.g., benzyl, phenethyl, or trityl. The alkenyl group has from 2 to 30 carbon atoms, e.g., vinyl or 1-dodecenyl. The alkynyl group has from 2 to 30 carbon atoms, e.g., thienyl, octynyl or phenylethynyl. The aromatic group represented by $R^1$ or $R^2$ is an aryl group having from 6 to 30 carbon atoms, e.g., phenyl or naphthyl. The heterocyclic group represented by $R^1$ or $R^2$ is saturated or unsaturated, and may be monocyclic or condensed ring, e.g., pyridyl, imidazolyl, thiazolyl, quinolyl, morpholino or thienyl.

The hydrazino group represented by $R^2$ is, for example, $R^1N(R^3)$—$N(R^5)$— of formula (H).

The group removed off under an alkaline condition represented by $R^3$, $R^4$ or $R^5$ is a group having 20 or less carbon atoms, e.g., an alkylsulfonyl group, an arylsulfonyl group, an acyl group, a dialkylaminomethyl group or a hydroxymethyl group. The alkyl group represented by $R^5$ is the same as the alkyl group described for $R^1$, and $R^3$, $R^4$ or $R^5$ preferably represents hydrogen atoms.

The alkyl group represented by $R^6$, $R^7$ or $R^8$ is an alkyl group having from 1 to 20 carbon atoms, e.g., methyl, cyclohexyl or dodecyl. The aryl group represented by $R^6$, $R^7$ or $R^8$ is an aryl group having from 6 to 20 carbon atoms, e.g., phenyl, naphthyl.

When $R^8$ represents an alkoxyl group, the alkyl moiety of which is the same as the alkyl group described for $R^6$, $R^7$ or $R^8$, and when $R^8$ represents an aryloxy group, the aryl moiety of which is the same as the aryl group described for $R^6$, $R^7$ or $R^8$.

The above described groups, if feasible, may have a substituent, and there can be cited as such a substituent an alkyl group, an acylamino group, a sulfonylamino group, a ureido group, a urethane group, an alkoxyl group, an aryloxy group, a hydroxy group, a carboxyl group, an aryl group, a carbamoyl group, a sulfamoyl group, an alkylthio group, an arylthio group, a sulfonyl group, a sulfinyl group, an acyl group, a halogen atom, a cyano group, a heterocyclic group or a sulfo group.

In particular, when $R^1$ represents an aromatic group, an electron donative group is preferred as a substituent, for example, an acylamino group, a sulfonylamino group, a ureido group, a urethane group or an alkoxyl group.

The terminology "formula (H) is diffusion resistance" means that the compound represented by formula (H) contains a ballast group or a group which heightens adsorption to silver halide. As a ballast group, a ballast group which is usually used in an immobile photographic material such as a coupler can be cited. In such a case, the ballast group preferably has a polar group as a substituent. In this case, a polar group is a group π value of which is −1.0 or less in combination, e.g., a hydroxyl, sulfonamido, amino, carboxy, carbamoyl, sulfamoyl, ureido, or heterocyclic group. When the compound represented by formula (H) includes a ballast group, the molecular weight of the compound is from 300 to 1,500, preferably from 450 to 1,500, and more preferably from 500 to 800.

As a group which heightens adsorption to silver halide surface, for example, a thiourea group, a mercapto group, a heterocyclic group or an azole group can be cited. As a diffusion resisting group, a ballast group is preferred to a silver halide adsorptive group.

In formula (H), G preferably represents —CO—, —COCO—, —$SO_2$—, —CON($R^6$)—, —PO($R^8$)—, —PO($R^8$)O— or —COO—, more preferably —CO—, —COCO—, —CON($R^6$)—, —PO($R^8$)—, —PO($R^8$)O— or —COO—, and most preferably —CO—.

The compounds represented by formula (H) are preferably represented by formula (H-I), (H-II), (H-III), (H-IV) or (H-V).

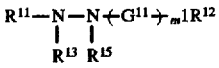

(H-I)

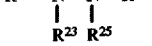

(H-II)

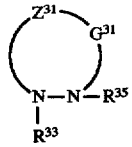

(H-III)

A polymer containing at least one of the following repeating unit

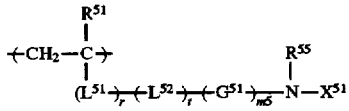

(H-IV)

wherein $R^{11}$ and $R^{12}$ each has the same meaning as $R^1$ in formula (H); $G^{11}$, $G^{31}$ and $G^{51}$ each has the same meaning as G in formula (H); $R^{13}$, $R^{23}$ and $R^{33}$ each has the same meaning as $R^3$ in formula (H); $R^{15}$, $R^{25}$, $R^{35}$ and $R^{55}$ each has the same meaning as $R^5$ in formula (H); $m^1$ and $m^5$ each has the same meaning as m in formula (H); $X^{51}$ has the same meaning as X in formula (H); $R^{21}$ represents a hydrogen atom, an aliphatic group, an aromatic group, a heterocyclic group or a hydrazino group; $R^{22}$ represents a cyano group, a nitro group, a perfluoroalkyl group (which has from 1 to 30 carbon atoms, e.g., trifluoromethyl, perfluorooctyl), or a heterocyclic group; and $Z^{31}$ in formula (H-III) represents methylene, ethylene, trimethylene, —CO—, 1,2-phenylene, —O—, —S—, —NH—, —NHNH— or a divalent linking group consisting of a combination of them, and a 5- to 8-membered ring is preferred.

In formula (H-IV), $R^{51}$ represents a hydrogen atom, a halogen atom or an alkyl group; $L^{51}$ represents —CO—, —$SO_2$—, —NH—, —O—, —S—, phenylene, alkylene or a divalent linking group consisting of a combination of them; $L^{52}$ represents a divalent group obtained by eliminating a hydrogen atom from $R^1$ in formula (H); and r and t each is 0 or 1. The compounds represented by formula (H-I), (H-II), (H-III) or (H-IV) are more preferably represented by the following formula (H-V):

$$R^{61}—NH—NH—G^{61}—R^{62} \quad \text{(H-V)}$$

wherein $R^{61}$ represents an aromatic group; $R^{62}$ represents an aliphatic group, an aromatic group or a heterocyclic group; and $G^{61}$ represents —CO—, —COCO—, —CON($R^{66}$)—, —PO($R^8$)—, —PO($R^8$)O— or —COO—; where $R^{66}$ has the same meaning as $R^6$ in formula (H), $R^8$ has the same meaning as $R^8$ in formula (H), and $R^{61}$ or $R^{66}$ contains a ballast group.

The compounds represented by the following formula (H-VI) are most preferred:

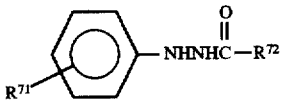

(H-VI)

wherein $R^{71}$ represents a substituent for a benzene ring, for example, the substituents described for $R^1$ in formula (H) can be cited, in particular, an electron donative group (acylamino, ureido, sulfonylamino, alkoxyl) is preferred; $R^{72}$ represents an aliphatic group or an aromatic group, and either of $R^{71}$ or $R^{72}$ has a ballast group having 8 or more carbon atoms, preferably $R^{71}$ or $R^{72}$ has a polar group.

Specific examples of the compounds represented by formula (H) are shown below but the present invention is not limited thereto.

H-1

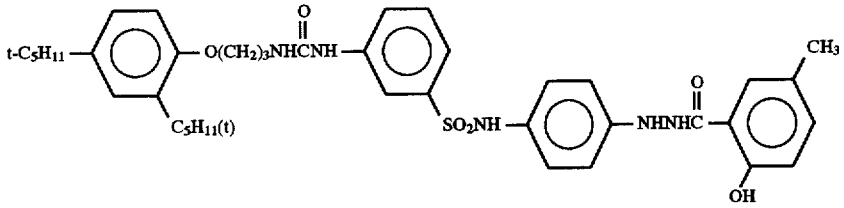

H-2

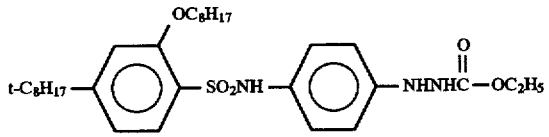

H-3

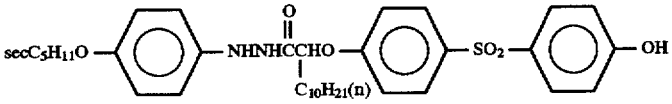

H-4

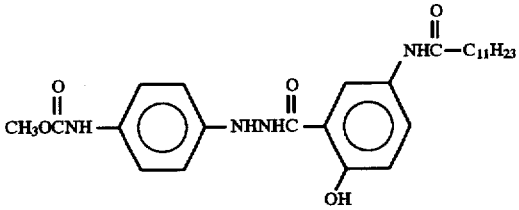

H-5

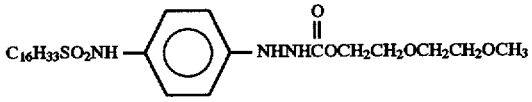

H-6

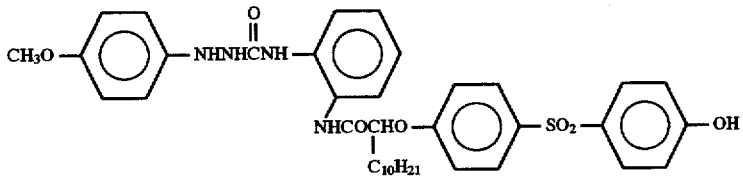

H-7

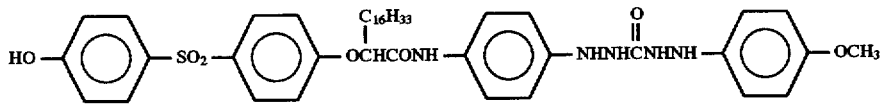

-continued
H-8
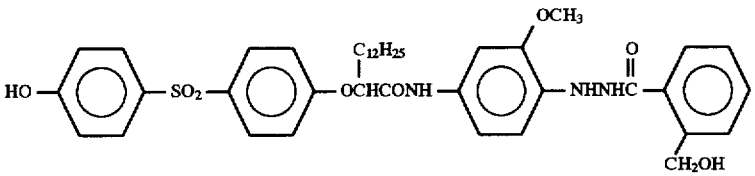
H-9
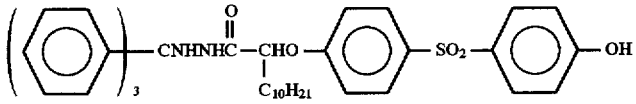
H-10
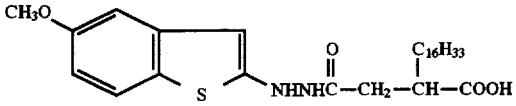
H-11
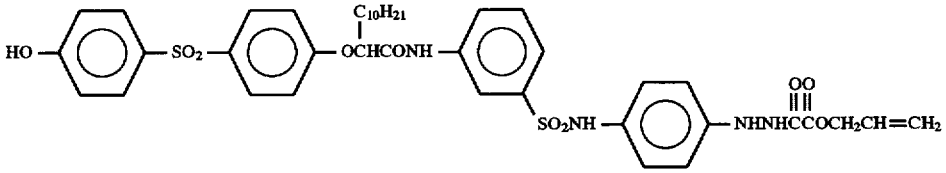
H-12
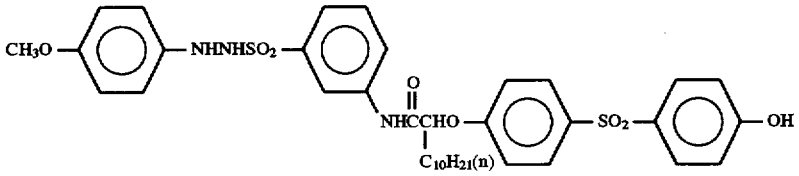
H-13
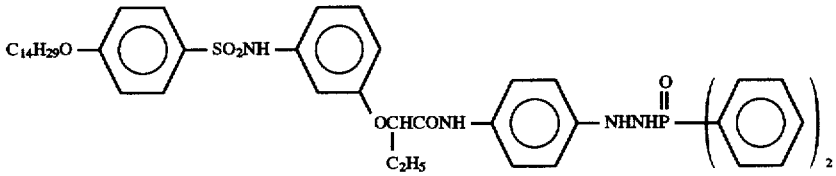
H-14
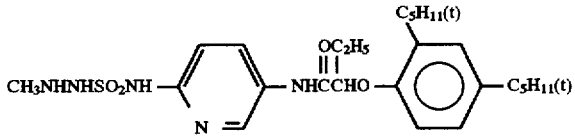
H-15
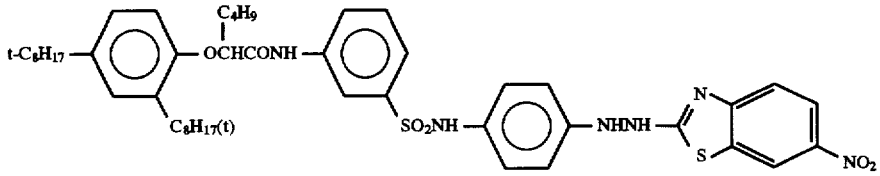
H-16
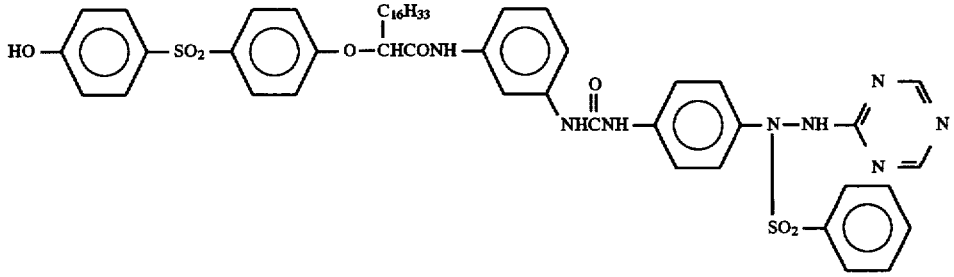

-continued
H-17
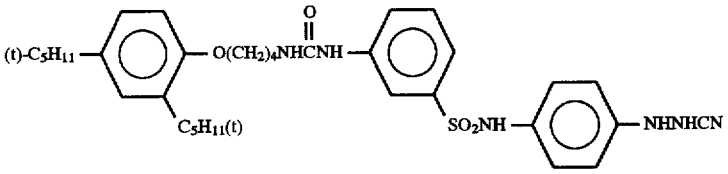
H-18
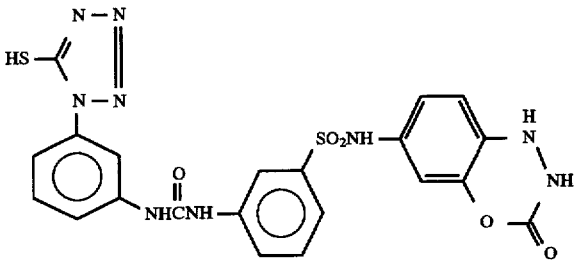
H-19
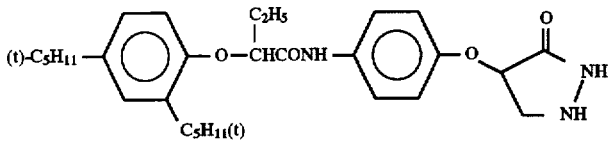
H-20
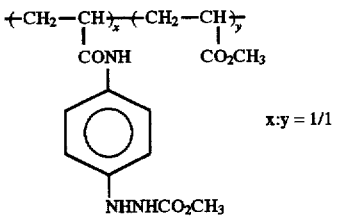
x:y = 1/1
H-21
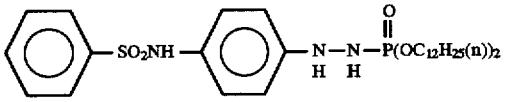
H-22
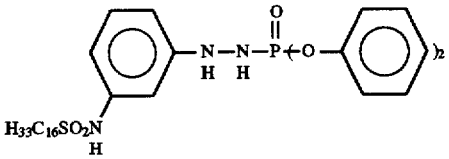
H-23
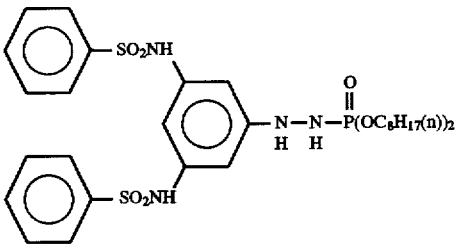
H-24
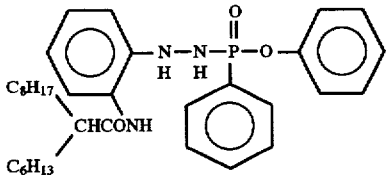

-continued

H-25

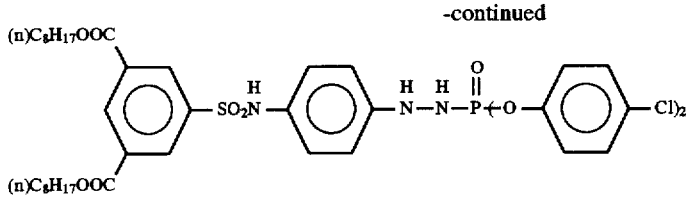

The compound represented by formula (H) of the present invention can easily be synthesized according to the methods disclosed, e.g., in JP-A-3-164735, JP-A-3-154051, JP-A-3-150560, JP-A-3-150562 and JP-A-1-315731 or the methods disclosed in the specifications cited therein.

The compound represented by formula (H) of the present invention can be used in an amount of from $1\times10^{-4}$ to 2.0 g/m$^2$, preferably from $2\times10^{-4}$ to 1.5 g/m$^2$, and more preferably from $1\times10^{-3}$ to 1.2 g/m$^2$.

The compound represented by formula (H) of the present invention can be used in combination of two or more.

The compound represented by formula (H) of the present invention can be added to either a light-sensitive emulsion layer or a light-insensitive layer, but is preferably added to a light-insensitive layer.

The light-sensitive material of the present invention can comprise at least one light-sensitive layer on a support. In a typical embodiment, the silver halide photographic material of the present invention comprises at least one light-sensitive layer consisting of a plurality of silver halide emulsion layers having substantially the same spectral sensitivity but different degrees of sensitivity on a support. The light-sensitive layer is a unit light-sensitive layer having a spectral sensitivity to any of blue light, green light and red light. In the multilayer silver halide color photographic material, these unit light-sensitive layers are generally arranged in the order of red-sensitive layer, green-sensitive layer and blue-sensitive layer from the support side. However, the order of arrangement can be reversed depending on the purpose, alternatively, the light-sensitive layers may be arranged in such a way that a layer having a different spectral sensitivity is interposed between layers having the same spectral sensitivity. Light-insensitive layers may be provided between the above-described silver halide light-sensitive layers, and on the uppermost layer and beneath the lowermost layer of the silver halide light-sensitive layers. These light-insensitive layers may contain couplers, DIR compounds and color mixing preventives described below. As the plurality of silver halide emulsion layers constituting each unit light-sensitive layer, a two-layer structure of a high sensitivity emulsion layer and a low sensitivity emulsion layer can be preferably used with the emulsion layers being arranged so as to decrease in sensitivity toward a support in turn as disclosed in German Patent 1,121,470 and British Patent 923,045. In addition, a low sensitivity emulsion layer may be provided farther from the support and a high sensitivity emulsion layer may be provided nearer to the support as disclosed in JP-A-57-112751, JP-A-62-200350, JP-A-62-206541 and JP-A-62-206543.

In one specific example, a low sensitivity blue-sensitive layer (BL)/a high sensitivity blue-sensitive layer (BH)/a high sensitivity green-sensitive layer (GH)/a low sensitivity green-sensitive layer (GL)/a high sensitivity red-sensitive layer (RH)/a low sensitivity red-sensitive layer (RL), or BH/BL/GL/GH/RH/RL, or BH/BL/GH/GL/RL/RH can be arranged in this order from the side farthest from the support.

A blue-sensitive layer/GH/RH/GL/RL can be arranged in this order from the side farthest from the support as disclosed in JP-B-55-34932. Further, a blue-sensitive layer/GL/RL/GH/RH can be arranged in this order from the side farthest from the support as disclosed in JP-A-56-25738 and JP-A-62-63936.

Further, useful arrangements include the arrangement in which there are three layers having different degrees of sensitivities with the sensitivity being lower towards the support such that the uppermost layer is a silver halide emulsion layer having the highest sensitivity, the middle layer is a silver halide emulsion layer having a lower sensitivity than that of the uppermost layer, and the lowermost layer is a silver halide emulsion layer having a lower sensitivity than that of the middle layer, as disclosed in JP-B-49-15495. In the case of the structure of this type comprising three layers having different degrees of sensitivity, the layers in the unit layer of the same spectral sensitivity may be arranged in the order of a middle sensitivity emulsion layer/a high sensitivity emulsion layer/a low sensitivity emulsion layer, from the side farthest from the support, as disclosed in JP-A-59-202464.

Alternatively, the layers can be arranged in the order of a high sensitivity emulsion layer/a low sensitivity emulsion layer/a middle sensitivity emulsion layer, or a low sensitivity emulsion layer/a middle sensitivity emulsion layer/a high sensitivity emulsion layer. Moreover, the arrangement may be varied as indicated above in the case where there are four or more layers.

For improving color reproducibility, a donor layer (CL) for an interlayer effect having a different spectral sensitivity distribution from a main light-sensitive layer such as BL, GL and RL may preferably be provided adjacent or close to the main light-sensitive layer, as disclosed in U.S. Pat. Nos. 4,663,271, 4,705,744, 4,707,436, JP-A-62-160448 and JP-A-63-89850.

The silver halides preferably used in the present invention are silver iodobromide, silver iodochloride or silver iodochlorobromide containing about 30 mol % or less of silver iodide, and particularly preferably used are silver iodobromide or silver iodochlorobromide containing from about 2 mol % to about 10 mol % of silver iodide.

Silver halide grains in a photographic emulsion may have a regular crystal form such as a cubic, octahedral or tetradecahedral form, an irregular crystal form such as a spherical or plate-like form, a form which has crystal defects such as twinned crystal planes, or a form which is a composite of these forms.

The silver halide grains may be a fine grain having a grain size of about 0.2 μm or less, or large size grains having a projected area diameter of up to about 10 μm, and the emulsion may be a polydisperse emulsion or a monodisperse emulsion.

The silver halide photographic emulsions for use in the present invention can be prepared using the methods disclosed, for example, in *Research Disclosure* (hereinafter abbreviated to *RD*), No. 17643 (December, 1978), pages 22 and 23, "I. Emulsion Preparation and Types", *RD*, No. 18716 (November, 1979), page 648, *RD*, No. 307105 (November, 1989), pages 863 to 865, P. Glafkides, *Chimie et Phisique Photographique*, Paul Montel (1967), G. F.

Duffin, *Photographic Emulsion Chemistry*, Focal Press (1966), and V. L. Zelikman et al., *Making and Coating Photographic Emulsion*, Focal Press (1964).

The monodisperse emulsions disclosed in U.S. Pat. Nos. 3,574,628, 3,655,394 and British Patent 1,413,748 are also preferred.

Further, tabular grains having an aspect ratio of about 3 or more can also be used in the present invention. Tabular grains can be easily prepared according to the methods disclosed, for example, in Gutoff, *Photographic Science and Engineering*, Vol. 14, pages 248 to 257 (1970), U.S. Pat. Nos. 4,434,226, 4,414,310, 4,433,048, 4,439,520 and British Patent 2,112,157.

The crystal structure may be uniform, or the interior and exterior parts of the grains may be comprised of different halogen compositions, or the grains may have a layered structure. Silver halides which have different compositions may be joined with an epitaxial junction or may be joined with compounds other than a silver halide, such as silver thiocyanate or lead oxide. Further, mixtures of grains which have various crystal forms may also be used.

The above described emulsions may be of the surface latent image type wherein the latent image is primarily formed on the surface, or of the internal latent image type wherein the latent image is formed within the grains, or of a type wherein the latent image is formed both at the surface and within the grains, but a negative type emulsion is essential. Of the internal latent image types, the emulsion may be a core/shell type internal latent image type emulsion as disclosed in JP-A-63-264740, and a method for preparation of such a core/shell type internal latent image type emulsion is disclosed in JP-A-59-133542. The thickness of the shell of this emulsion varies depending on the development process, but is preferably from 3 to 40 nm, and particularly preferably from 5 to 20 nm.

The silver halide emulsion for use in the present invention is usually subjected to physical ripening, chemical ripening and spectral sensitization. Additives for use in such processes are disclosed in *RD*, No. 17643, *RD*, No. 18716, and *RD*, No. 307105, and the locations of these disclosures are summarized in a table below.

In the photographic material of the present invention, two or more different types of emulsions which are different in terms of at least one of the characteristics of grain size, grain size distribution, halogen composition, the form of the grains, or light sensitivity of the light-sensitive silver halide emulsion can be used in admixture in the same layer.

It is preferred to use the silver halide grains having a fogged grain surface as disclosed in U.S. Pat. No. 4,082,553, the silver halide grains having a fogged grain interior as disclosed in U.S. Pat. No. 4,626,498 and JP-A-59-214852, or colloidal silver in light-sensitive silver halide emulsion layers and/or substantially light-insensitive hydrophilic colloid layers. Silver halide grains having a fogged grain interior or surface are silver halide grains which can be developed uniformly (not imagewise) irrespective of whether these grains are in an unexposed part or an exposed part of the photographic material, and methods for the preparation thereof are disclosed in U.S. Pat. No. 4,626,498 and JP-A-59-214852. The silver halide which forms the internal nuclei of a core/shell type silver halide grains having a fogged grain interior may have different halogen compositions. The silver halide having a fogged grain interior or surface may be any of silver chloride, silver chlorobromide, silver iodobromide, or silver chloroiodobromide. The average grain size of these fogged silver halide grains is preferably from 0.01 to 0.75 μm, and particularly preferably from 0.05 to 0.6 μm. Further, the form of the grains may be regular grains and may be a polydisperse emulsion, but a monodisperse emulsion (at least 95% of which have a grain size within ±40% of the average grain size in terms of the weight or number of silver halide grains) is preferred.

The use of light-insensitive fine grained silver halides is preferred in the present invention. Light-insensitive fine grained silver halides are fine grained silver halides which are not sensitive to light upon imagewise exposure for obtaining color images and which do not substantially undergo development during development processing, and they are preferably not pre-fogged. The fine grained silver halide has a silver bromide content of from 0 to 100 mol %, and may contain silver chloride and/or silver iodide, if necessary. The fine grained silver halides which have a silver iodide content of from 0.5 to 10 mol % are preferred. The average grain size of the fine grained silver halide (the average value of the diameters of the circles corresponding to the projected areas) is preferably from 0.01 to 0.5 μm, more preferably from 0.02 to 0.2 μm.

The fine grained silver halide can be prepared by the same methods as the preparation of generally used light-sensitive silver halides. In the preparation of the fine grained silver halide, the surface of the silver halide grains does not need to be optically sensitized and also does not need to be spectrally sensitized. However, it is preferred to previously include known stabilizers such as triazole based, azaindene based, benzothiazolium based, or mercapto based compounds, or zinc compounds in the fine grained silver halide before addition to the coating solution. Colloidal silver can be included in the layer containing the fine grained silver halide grains.

The coating weight of silver in the photographic material of the present invention is preferably 6.0 g/m$^2$ or less, and most preferably 4.5 g/m$^2$ or less.

Photographic additives which can be used in the present invention are disclosed in *RD* and the locations related thereto are indicated in the table below.

| Type of Additives | RD 17643 | RD 18716 | RD 307105 |
|---|---|---|---|
| 1. Chemical Sensitizers | page 23 | page 648, right column | page 866 |
| 2. Sensitivity Increasing Agents | — | page 648, right column | — |
| 3. Spectral Sensitizers and Supersensitizers | pages 23–24 | page 648, right column to page 649, right column | pages 866–868 |
| 4. Whitening Agents | page 24 | page 647, right coluinn | page 868 |

-continued

| Type of Additives | RD 17643 | RD 18716 | RD 307105 |
|---|---|---|---|
| 5. Light Absorbing Agents, Filter Dyes, and Ultraviolet Absorbing Agents | pages 25–26 | page 649, right column to page 650, left column | page 873 |
| 6. Binders | page 26 | page 651, left column | pages 873–874 |
| 7. Plasticizers and Lubricants | page 27 | page 650, right column | page 876 |
| 8. Coating Aids and Surfactants | pages 26–27 | page 650, right column | pages 875–876 |
| 9. Antistatic Agents | page 27 | page 650, right column | pages 876–877 |
| 10. Matting Agents | — | — | pages 878–879 |

Various dye-forming couplers can be used in the present invention, and the following couplers are particularly preferred.

Yellow Couplers

The couplers represented by formula (I) or (II) disclosed in EP-A-502424; the couplers represented by formula (1) or (2) disclosed in EP-A-513496 (in particular, Y-28 on page 18); the couplers represented by formula (I) disclosed in claim 1 of EP-A-568037; the couplers represented by formula (I), column 1, lines 45 to 55 of U.S. Pat. No. 5,066,576; the couplers represented by formula (I), paragraph 0008 of JP-A-4-274425; the couplers disclosed in claim 1 on page 40 of EP-A-498381 (in particular, D-35 on page 18); the couplers represented by formula (Y) on page 4 of EP-A-447969 (in particular, Y-1 (page 17) and Y-54 (page 41)); and the couplers represented by any of formulae (II) to (IV), column 7, lines 36 to 58 of U.S. Pat. No. 4,476,219 (in particular, II-17 and II-19 (column 17), and II-24 (column 19)).

Magenta Couplers

L-57 (page 11, right lower column), L-68 (page 12, right lower column), and L-77 (page 13, right lower column) of JP-A-3-39737; [A-4]-63 (page 134), and [A-4]-73 to [A-4]-75 (page 139) of European Patent 456257; M-4 to M-6 (page 26) and M-7 (page 27) of European Patent 486965; M-45 (page 19) of EP-A-571959; (M-1) (page 6) of JP-A-5-204106; and M-22, paragraph 0237 of JP-A-4-362631.

Cyan Couplers

CX-1, CX-3, CX-4, CX-5, CX-11, CX-12, CX-14 and CX-15 (pages 14 to 16) of JP-A-4-204843; C-7 and C-10 (page 35), C-34 and C-35 (page 37), and (I-1) and (I-17) (pages 42 and 43) of JP-A-4-43345; and the couplers represented by formula (Ia) or (Ib) disclosed in claim 1 of JP-A-4-67385.

Polymer Couplers

P-1 and P-5 (page 11) of JP-A-2-44345.

Couplers the colored dyes of which have an appropriate diffusibility

The couplers disclosed in U.S. Pat. No. 4,366,237, British Patent 2,125,570, EP-B-96873 and German Patent 3,234,533 are preferred as couplers the colored dyes of which have an appropriate diffusibility.

Couplers for correcting the unnecessary absorption of colored dyes:

Examples of preferred couplers for correcting the unnecessary absorption of colored dyes include the yellow colored cyan couplers represented by formula (CI), (CII), (CIII) or (CIV) disclosed on page 5 of EP-A-456257 (in particular, YC-86 on page 84); the yellow colored magenta couplers ExM-7 (page 202), EX-1 (page 249), and EX-7 (page 251) disclosed in EP-A-456257; the magenta colored cyan couplers CC-9 (column 8) and CC-13 (column 10) disclosed in U.S. Pat. No. 4,833,069; the coupler (2) (column 8) of U.S. Pat. No. 4,837,136; and the colorless masking couplers represented by formula (A) disclosed in claim 1 of WO 92/11575 (in particular, the compounds disclosed on pages 36 to 45).

Examples of compounds (inclusive of couplers) which release photographically useful residual groups of compounds upon reacting with the oxidation product of a developing agent include the following:

Development inhibitor releasing compounds

- the compounds represented by formula (I), (II), (III) or (IV) disclosed on page 11 of EP-A-378236 (in particular, T-101 (page 30), T-104 (page 31), T-113 (page 36), T-131 (page 45), T-144 (page 51) and T-158 (page 58);
- the compounds represented by formula (I) disclosed on page 7 of EP-A-436938 (in particular, D-49 (page 51));
- the compounds represented by formula (1) disclosed in EP-A-568037 (in particular, (23) (page 11); and
- the compounds represented by formula (I), (II) or (III) disclosed on pages 5 and 6 of EP-A-440195 (in particular, I-(1) on page 29);

Bleaching accelerator releasing compounds

- the compounds represented by formula (I) or (I') disclosed on page 5 of EP-A-310125 (in particular, (60) and (61) on page 61); and
- the compounds represented by formula (I) disclosed in claim 1 of JP-A-6-59411 (in particular, (7) on page 7);

Ligand releasing compounds:

- the compounds represented by LIG-X disclosed in claim 1 of U.S. Pat. No. 4,555,478 (in particular, the compounds in lines 21 to 41, column 12);

Leuco dye releasing compounds

- compounds 1 to 6, columns 3 to 8 of U.S. Pat. No. 4,749,641;

Fluorescent dye releasing compounds

- the compounds represented by COUP-DYE disclosed in claim 1 of U.S. Pat. No. 4,774,181 (in particular, compounds 1 to 11, columns 7 to 10);

Development accelerator releasing or fogging agent releasing compounds

- the compounds represented by formula (1), (2) or (3), column 3 of U.S. Pat. No. 4,656,123 (in particular, (I-22), column 25); and
- compound ExZK-2, lines 36 to 38, page 75 of EP-A-450637; and Compounds which release dyes the color of which is restored after elimination

- the compounds represented by formula (I) disclosed in claim 1 of U.S. Pat. No. 4,857,447 (in particular, Y-1 to Y-19, columns 25 to 36).

Preferred additives other than couplers are listed below:

Dispersion mediums of oil-soluble organic

P-3, P-5, P-16, P-19, P-25, P-30, P-42, P-49, P-54, P-55, P-66, P-81, P-85, P-86 and P-93 (pages 140 to 144) of JP-A-62-215272;

Latexes for impregnation of oil-soluble organic compound the latexes disclosed in U.S. Pat. No. 4,199,363;

Scavengers for the oxidation product of a developing agent the compounds represented by formula (I), lines 54 to 62, column 2 of U.S. Pat. No. 4,978,606 (in particular, I-(1), I-(2), I-(6) and I-(12), columns 4 and 5), and the compounds represented by the formula disclosed in lines 5 to 10, column 2 of U.S. Pat. No. 4,923,787 (in particular, compound 1, column 3);

Stain inhibitors the compounds represented by formula (I), (II) or (III), lines 30 to 33, page 4 of EP-A-298321 (in particular, I-47, I-72, III-1 and III-27, pages 24 to 48);

Discoloration inhibitors

A-6, A-7, A-20, A-21, A-23, A-24, A-25, A-26, A-30, A-37, A-40, A-42, A-48, A-63, A-90, A-92, A-94 and A-164 (pages 69 to 118) of EP-A-298321, II-1 to III-23, columns 25 to 38 of U.S. Pat. No. 5,122,444 (in particular, III-10), I-1 to III-4, pages 8 to 12 of EP-A-471347 (in particular, II-2), and A-1 to A-48, columns 32 to 40 of U.S. Pat. No. 5,139,931 (in particular, A-39 and A-42);

Compounds for reducing the using amounts of color intensifiers and color mixing preventives I-1 to II-15, pages 5 to 24 of EP-A-411324 (in particular, I-46);

Formaldehyde scavengers:

SCV-1 to SCV-28, pages 24 to 29 of EP-A-477932 (in particular, SCV-8);

Hardening agents

H-1, H-4, H-6, H-8 and H-14 on page 17 of JP-A-1-214845, the compounds represented by any of formulae (VII) to (XII), columns 13 to 23 of U.S. Pat. No. 4,618,573 (H-1 to H-54), the compounds represented by formula (6), right lower column, page 8 of JP-A-2-214852 (H-1 to H-76) (in particular, H-14), and the compounds disclosed in claim 1 of U.S. Pat. No. 3,325,287;

Development inhibitor precursors

P-24, P-37 and P-39, pages 6 and 7 of JP-A-62-168139, and the compounds disclosed in claim 1 of U.S. Pat. No. 5,019,492 (in particular, compounds 28 and 29, column 7);

Fungicides and biocides

I-1 to III-43, columns 3 to 15 of U.S. Pat. No. 4,923,790 (in particular, II-1, II-9, II-10, II-18 and III-25);

Stabilizers and antifoggants

I-1 to (14), columns 6 to 16 of U.S. Pat. No. 4,923,793 (in particular, I-1, 60, (2) and (13)); and compounds 1 to 65, columns 25 to 32 of U.S. Pat. No. 4,952,483 (in particular, compound 36);

Chemical sensitizers triphenylphosphine selenide, and compound 50 disclosed in JP-A-5-40324;

Dyes a-1 to b-20, pages 15 to 18 (in particular, a-1, a-12, a-18, a-27, a-35, a-36, and b-5), and V-1 to V-23, pages 27 to 29 (in particular, V-1) of JP-A-3-156450, F-I-1 to F-II-43, pages 33 to 55 of EP-A-445627 (in particular, F-I-11 and F-II-8), III-1 to III-36, pages 17 to 28 of EP-A-457153 (in particular, III-1 and III-3), crystallite dispersions of Dye-1 to Dye-124, pages 8 to 26 of WO 88/04794, compounds 1 to 22, pages 6 to 11 of EP-A-319999 (in particular, compound 1), compounds D-1 to D-87 represented by any of formulae (1) to (3), pages 3 to 28 of EP-A-519306, compounds 1 to 22 represented by formula (I), columns 3 to 10 of U.S. Pat. No. 4,268,622, and compounds (1) to (31) represented by formula (I), columns 2 to 9 of U.S. Pat. No. 4,923,788;

Ultraviolet absorbing agents:

compounds (18b) to (18r) represented by formula (1), 101 to 427, pages 6 to 9 of JP-A-46-3335, compounds (3) to (66) represented by formula (I), pages 10 to 44, and compounds HBT-1 to HBT-10 represented by formula (III), page 14, of EP-A-520938, and compounds (1) to (31) represented by formula (1), columns 2 to 9 of EP-A-521823.

The present invention can be applied to various color photographic materials such as color negative films for general and cinematographic uses, color reversal films for slide and television uses, color papers, color positive films and color reversal papers. The present invention can also preferably be applied to the film units equipped with lenses as disclosed in JP-B-2-32615 and JP-B-U-3-39784 (the term "JP-B-U" as used herein means an "examined Japanese utility model publication").

Suitable supports which can be used in the present invention are disclosed, for example, in *RD*, No. 17643, page 28, *RD*, No. 18716, from page 647, right column to page 648, left column, and *RD*, No. 307105, page 879.

The photographic material of the present invention has a total film thickness of all the hydrophilic colloid layers on the side where the silver halide emulsion layers are located of preferably 28 μm or less, more preferably 23 μm or less, still more preferably 18 μm or less, and most preferably 16 μm or less. Further, the film swelling rate $T_{1/2}$ is preferably 30 seconds or less, more preferably 20 seconds or less. $T_{1/2}$ is defined as the time to reach ½ of the saturated film thickness, taking 90% of the maximum swollen film thickness reached when being processed at 30° C. for 3 minutes and 15 seconds in a color developing solution as the saturated film thickness. The film thickness means the film thickness measured under conditions of 25° C., 55% relative humidity (stored for 2 days), and $T_{1/2}$ can be measured using a swellometer of the type described in A. Green, *Photogr. Sci. Eng.*, Vol. 19, No. 2, pages 124 to 129. $T_{1/2}$ can be adjusted by adding hardening agents to gelatin which is used as a binder, or by changing the aging conditions after coating. Further, a swelling factor of from 150% to 400% is preferred. The swelling factor can be calculated from the maximum swollen film thickness obtained under the conditions described above using the equation: (maximum swollen film thickness—film thickness)/film thickness.

The provision of hydrophilic colloid layers (known as backing layers) having a total dry film thickness of from 2 μm to 20 μm on the side of the support opposite to the side on which emulsion layers are provided is preferred in the photographic material of the present invention. The inclusion of the above described light absorbing agents, filter dyes, ultraviolet absorbing agents, antistatic agents, hardening agents, binders, plasticizers, lubricants, coating aids, and surfactants in the backing layers is preferred. The swelling factor of the backing layer is preferably from 150 to 500%.

The photographic material of the present invention can be development processed by the ordinary methods disclosed in *RD*, No. 17643, pages 28 and 29, *RD*, No. 18716, page 651, from left column to right column, and *RD*, No. 307105, pages 880 and 881.

The color developing solution for use in the development processing of the photographic material of the present invention is preferably an alkaline aqueous solution which contains an aromatic primary amine developing agent as a main component. Aminophenol based compounds are useful as a color developing agent, but the use of p-phenylenediamine based compounds is preferred, and representative examples thereof include the compounds disclosed in lines 43 to 52, page 28 of EP-A-556700. Two or more of these compounds can be used in combination according to purposes.

The color developing solution generally contains a pH buffer such as alkali metal carbonate, borate or phosphate, or a development inhibitor or an antifoggant such as chloride, bromide, iodide, benzimidazoles, benzothiazoles, or mercapto compounds. The color developing solution may also contain, if necessary, various preservatives such as hydroxylamine, diethylhydroxylamine, sulfite, hydrazines, e.g., N,N-bis-carboxymethylhydrazine, phenylsemicarbazides, triethanolamine and catecholsulfonic acids, an organic solvent such as ethylene glycol and diethylene glycol, a development accelerator such as benzyl alcohol, polyethylene glycol, quaternary ammonium salt, and amines, a dye-forming coupler, a competitive coupler, an auxiliary developing agent such as 1-phenyl-3-pyrazolidone, a thickener, and various chelating agents typified by aminopolycarboxylic acid, aminopolyphosphonic acid, alkylphosphonic acid, and phosphonocarboxylic acid, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediaminedi(o-hydroxyphenylacetic acid) and salts of these acids.

Further, the color development is generally carried out after the black-and-white development in the case of reversal processing. In the black-and-white developing solution, known black-and-white developing agents such as hydroxybenzenes, e.g., hydroquinone, 3-pyrazolidones, e.g., 1-phenyl-3-pyrazolidone, or aminophenols, e.g., N-methyl-p-aminophenol can be used alone or in combination. The pH of these color developing solution and black-and-white developing solution is generally from 9 to 12. The replenishment rate of these developing solutions depends on the color photographic material to be processed but, in general, it is 3 liters or less per square meter of the photographic material, and the amount can be reduced to 500 ml or less by reducing the bromide ion concentration in the replenisher. In the case when the replenishment rate is reduced, it is preferred to prevent evaporation and air oxidation of the solution by minimizing the area of contact of the solution with the air in the processing tank.

The processing effect by the contact of the photographic processing solution with the air in a processing tank can be evaluated by the following equation: Open factor=[Contact area of processing solution with air ($cm^2$)]÷[Volume of processing solution ($cm^3$)]. This open factor is preferably 0.1 or less, more preferably from 0.001 to 0.05. The method using a movable lid as disclosed in JP-A-1-82033 and the slit development processing method as disclosed in JP-A-63-216050 can be used as means of reducing the open factor, as well as the provision of a shielding material such as a floating lid on the surface of the photographic processing solution in the processing tank. Reduction of the open factor is preferred not only in the processes of the color development and the black-and-white development but also in all the subsequent processes such as the bleaching process, the bleach-fixing process, the fixing process, the washing process and the stabilizing process. Further, the replenishment rate can be reduced by suppressing the accumulation of the bromide ion in the developing solution.

The color development processing time is usually set between 2 and 5 minutes, but shorter processing time is available by raising the temperature and the pH and increasing the concentration of the color developing agent.

A photographic emulsion layer is generally bleaching processed after being color development processed. A bleaching process and a fixing process may be carried out at the same time (bleach-fixing process) or may be performed separately. A processing method comprising carrying out a bleach-fixing process after a bleaching process can be adopted for further rapid processing. Also, processing in two successive bleach-fixing baths, fixing process before bleach-fixing process, or bleaching process after bleach-fixing process may be optionally selected according to purposes. Compounds of polyvalent metals such as iron(III), peracids, quinones, and nitro compounds are used as a bleaching agent. Representative examples of bleaching agents which are preferably used in the present invention include a bleaching agent such as organic complex salts of iron(III) with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid or malic acid. The use of aminopolycarboxylic acid iron(III) complex salts such as ethylenediaminetetraacetic acid iron(III) complex salts and 1,3-diaminopropanetetraacetic acid iron(III) complex salts is particularly preferred of them from the point of providing rapid processing and preventing environmental pollution. Further, aminopolycarboxylic acid iron (III) complex salts are particularly useful in both of a bleaching solution and a bleach-fixing solution. The pH of the bleaching solution or the bleach-fixing solution in which these aminopolycarboxylic acid iron(III) complex salts are included is generally from 4.0 to 8, but lower pH can be used to speed up the processing.

Bleaching accelerators can be used, if necessary, in the bleaching solution, the bleach-fixing solution, or the prebaths thereof. Specific examples of useful bleaching accelerators are disclosed in the following publications: the compounds which have a mercapto group or a disulfido group disclosed in U.S. Pat. No. 3,893,858, German Patents 1,290,812, 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *RD*, No. 17129 (July, 1978); the thiazolidine derivatives disclosed in JP-A-50-140129; the thiourea derivatives disclosed in JP-B-45- 8506, JP-A-52-20832, JP-A-53-32735, and U.S. Pat. No. 3,706,561; the iodides disclosed in German Patent 1,127,715 and JP-A-58-

16235; the polyoxyethylene compounds disclosed in German Patents 966,410 and 2,748,430; the polyamine compounds disclosed in JP-B-45-8836; the other compounds disclosed in JP-A-49-40943, JP-A-49-59644, JP-A-53-94927, JP-A-54-35727, JP-A-55-26506 and JP-A-58-163940; and bromide ions. The compounds which have a mercapto group or a disulfido group are preferred from the point of providing large accelerating effect, and those disclosed in U.S. Pat. No. 3,893,858, German Patent 1,290,812 and JP-A-53-95630 are particularly preferred of all. Further, the compounds disclosed in U.S. Pat. No. 4,552,834 are also preferred. These bleaching accelerators can be included in photographic materials. These bleaching accelerators are especially effective when bleach-fixing color photographic materials for photographing.

It is preferred to include organic acids in a bleaching solution and a bleach-fixing solution, in addition to the above compounds, for inhibiting bleaching stain. Particularly preferred organic acids are compounds having an acid dissociation constant (pKa) of from 2 to 5, specifically, acetic acid, propionic acid, and hydroxyacetic acid are preferred.

Thiosulfate, thiocyanate, thioether based compounds, thioureas, and large amounts of iodide can be used as the fixing agent which is used in a fixing solution and bleach-fixing solution, however, thiosulfate is generally used, in particular, ammonium thiosulfate can be most widely used. Further, the combined use of thiosulfate with thiocyanate, thioether based compounds and/or thiourea is also preferred. As preservatives for a fixing solution and a bleach-fixing solution, sulfite, bisulfite, carbonyl-bisulfite addition products or the sulfinic acid compounds disclosed in EP-A-294769 are preferred. Moreover, aminopolycarboxylic acids and organic phosphonic acids are preferably added to a fixing solution and a bleach-fixing solution for stabilizing the solutions.

In the present invention, the addition of compounds having a pKa of from 6.0 to 9.0 to a fixing solution or a bleach-fixing solution is preferred for controlling pH, preferably imidazoles such as imidazole, 1-methylimidazole, 1-ethylimidazole and 2-methylimidazole, in an amount of from 0.1 to 10 mol per liter.

The total processing time of the desilvering process is preferably shorter in the range not generating a desilvering failure. The desilvering processing time is preferably from 1 minute to 3 minutes and more preferably from 1 minute to 2 minutes. Further, the processing temperature is generally from 25° C. to 50° C., and preferably from 35° C. to 45° C. In the preferred temperature range, the desilvering rate is increased and the occurrence of staining after processing is effectively prevented.

Stirring as vigorous as possible in the desilvering process is preferred. Specific examples of the methods of forced stirring include the method wherein a jet of the processing solution is impinged on the surface of the emulsion of the photographic material as disclosed in JP-A-62-183460, the method wherein the stirring effect is raised using a rotating means as disclosed in JP-A-62-183461, the method wherein the photographic material is moved with a wiper blade, which is installed in the solution, in contact with the surface of the emulsion, and the generated turbulent flow at the surface of the emulsion increases the stirring effect, and the method wherein the circulating flow rate of the entire processing solution is increased. These means for increasing the stirring level are effective for the bleaching solution, the bleach-fixing solution and the fixing solution. It is supposed that the increased stirring level increases the rate of supply of the bleaching agent and the fixing agent to the emulsion film and, as a result, increases the desilvering rate. Further, the above means of increasing stirring are more effective when a bleaching accelerator is used, and it is possible to extremely increase the bleaching accelerating effect and to eliminate the fixing hindrance action due to the bleaching accelerator.

The automatic processors which are used in the present invention preferably have the means of transporting photographic materials as disclosed in JP-A-60-191257, JP-A-60-191258, and JP-A-60-191259. As described in the above JP-A-60-191257, such a transporting means can greatly reduce the carry-over of the processing solution from the previous bath to the next bath and effectively prevent the deterioration of the performances of the processing solution, and is especially effective in reducing the processing time of each processing step and reducing the replenishment rate of each processing solution.

The photographic material of the present invention is generally subjected to a washing step and/or a stabilizing step after the desilvering step. The amount of washing water in the washing step can be selected from a wide range according to the characteristics and the application of the photographic materials (for example, the materials used such as couplers, etc.), the temperature of a washing water, the number of washing tanks (the number of washing stages), the replenishing system, that is, whether a countercurrent system or a concurrent system, and other various conditions. Of the foregoing conditions, the relationship between the number of washing tanks and the amount of water in a multistage countercurrent system can be obtained by the method described in *Journal of the Society of Motion Picture and Television Engineers*, Vol. 64, pages 248 to 253 (May, 1955). According to the multistage countercurrent system of the above literature, the amount of the washing water can be greatly reduced, however, problems arise that bacteria proliferate due to the increased residence time of the water in the tanks, and suspended matters produced thereby adhere to the photographic material. The method of reducing the calcium ion and magnesium ion concentrations as disclosed in JP-A-62-288838 can be used as a very effective means for overcoming these problems. Also, the isothiazolone compounds and the thiabendazoles as disclosed in JP-A-57-8542, the chlorine based antibacterial agents such as chlorinated sodium isocyanurate, the benzotriazole, and the antibacterial agents disclosed in Hiroshi Horiguchi, *Bohkin Bohbai no Kagaku* (*Antibacterial and Antifungal Chemistry*), published by Sankyo Shuppan K.K. (1986), *Biseibutsu no Mekkin, Sakkin, Bohbai Gijutsu* (*Germicidal and Antifungal Techniques of Microorganisms*), edited by Eisei Gijutsukai, published by Kogyo Gijutsukai (1982), and *Bohkin Bohbai Zai Jiten* (*Antibacterial and Antifungal Agents Thesaurus*), edited by Nippon Bohkin Bohbai Gakkai (1986), can be used.

The pH of the washing water in the processing of the photographic material of the present invention is generally from 4 to 9 and preferably from 5 to 8. The temperature and the time of a washing step can be selected variously according to the characteristics and the end use purpose of the photographic material to be processed, but is generally from 15° to 45° C. for 20 seconds to 10 minutes, and preferably from 25° to 40° C. for 30 seconds to 5 minutes. Further, the photographic material of the present invention can be processed directly with a stabilizing solution without employing a washing step as described above. Any known methods as disclosed in JP-A-57-8543, JP-A-58-14834 and JP-A-60-220345 can be used in such a stabilizing process.

Further, there is also a case in which a stabilizing process is carried out following the above described washing process, and the stabilizing bath which contains a dye stabilizer and a surfactant which is used as a final bath for color photographic materials for photographing is one example of such a process. Aldehydes such as formaldehyde and glutaraldehyde, N-methylol compounds, hexamethylenetetramine and sulfite addition products of aldehyde can be used as a dye stabilizer. Various chelating agents and fungicides can also be added to a stabilizing bath.

The overflow generated by the replenishment of the above described washing water and/or stabilizing solution can be reused in other steps such as a desilvering step, etc.

When the above each processing solution is concentrated due to evaporation by the processing using an automatic processor, etc., it is preferred to replenish an appropriate amount of water for the correction of concentration.

Color developing agents may be incorporated into a photographic material of the present invention to simplify and speed up the processing. Color developing agent precursors are preferred for the incorporation. For example, the indoaniline based compounds disclosed in U.S. Pat. No. 3,342,597, the Schiff's base type compounds disclosed in U.S. Pat. No. 3,342,599, *Research Disclosure,* Nos. 14850 and 15159, the aldol compounds disclosed in *RD*, No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be included, if required, in the photographic material of the present invention to accelerate color development. Typical compounds are disclosed in JP-A-56-64339, JP-A-57-144547 and JP-A-58-115438.

The various processing solutions of the present invention are used at a temperature of from 10° C. to 50° C. The standard temperature is generally from 33° C. to 38° C., however, higher temperatures can be used to accelerate the processing to shorten the processing time, on the contrary, lower temperature can be used to improve the picture quality and stabilize the processing solutions.

A transparent magnetic recording layer for use in the present invention is explained below.

A transparent magnetic recording layer for use in the present invention is a layer coated on a support with an aqueous or organic solvent based coating solution comprising magnetic grains dispersed in a binder.

Examples of the magnetic grains for use in the present invention include ferromagnetic iron oxide such as $\gamma$-$Fe_2O_3$, Co-adhered $\gamma$-$Fe_2O_3$, Co-adhered magnetite, Co-containing magnetite, ferromagnetic chromium dioxide, ferromagnetic metal, ferromagnetic alloy, hexagonal system Ba ferrite, Sr ferrite, Pb ferrite, and Ca ferrite. Co-adhered ferromagnetic iron oxide such as Co-adhered $\gamma$-$Fe_2O_3$ is preferred. The shape of the grain may be any of acicular shape, a granular shape, a spherical shape, a cubic shape, or a plate-like shape. The specific surface area ($S_{BET}$) is preferably 20 $m^2/g$ or more, and particularly preferably 30 $m^2/g$ or more. The saturation magnetization ($\sigma_s$) of the ferromagnetic substance is preferably from $3.0\times10^4$ to $3.0\times10^5$ A/m and particularly preferably from $4.0\times10^4$ to $2.5\times10^5$ A/m. The ferromagnetic grains may be surface treated with silica and/or alumina and organic materials. Further, the surface of the magnetic grains may be treated with a silane coupling agent or a titanium coupling agent as disclosed in JP-A-6-161032. In addition, the magnetic grains the surfaces of which are covered with inorganic or organic substance as disclosed in JP-A-4-259911 and JP-A-5-81652 can also be used.

The binders which can be used for the magnetic grains includes the thermoplastic resins, thermosetting resins, radiation curable resins, reactive type resins, acid-, alkali- or biodegradable polymers, natural polymers (e.g., cellulose derivatives, sugar derivatives), and mixtures thereof disclosed in JP-A-4-219569. The above described resins have a Tg of from −40° C. to 300° C., and a weight average molecular weight of from 2,000 to 1,000,000. Examples of the binders include vinyl based copolymers, cellulose derivatives such as cellulose diacetate, cellulose triacetate, cellulose acetate propionate, cellulose acetate butyrate and cellulose tripropionate, acrylic resins, and polyvinyl acetal resins. Gelatin is also preferably used. Cellulose di(tri) acetate is particularly preferred. The binder can be subjected to curing treatment by adding epoxy based, aziridine based or isocyanate based crosslinking agent. Examples of the isocyanate based crosslinking agents include isocyanates such as tolylenediisocyanate, 4,4'-diphenylmethanediisocyanate, hexamethylenediisocyanate and xylenediisocyanate, reaction products of these isocyanates with polyalcohols (e.g., a reaction product of 3 mol of tolylenediisocyanate with 1 mol of trimethylolpropane), and polyisocyanate formed by condensation of these isocyanates, and they are disclosed in JP-A-6-59357.

The above magnetic substances are dispersed in a binder preferably using, as disclosed in JP-A-6-35092, a kneader, a pin type mill, and an annular type mill, and the combined use thereof is also preferred. The dispersants disclosed in JP-A-5-88283 or other known dispersants can be used. The thickness of a magnetic recording layer is from 0.1 μm to 10 μm, preferably from 0.2 μm to 5 μm, and more preferably from 0.3 μm to 3 μm. The weight ratio of the magnetic grains to the binder is preferably from 0.5/100 to 60/100, and more preferably from 1/100 to 30/100. The coating amount of the magnetic grains is from 0.005 to 3 $g/m^2$, preferably from 0.01 to 2 $g/m^2$, and more preferably from 0.02 to 0.5 $g/m^2$. A magnetic recording layer can be provided on the back surface of the photographic support entirely or in stripe by coating or printing. Coating of a magnetic recording layer can be carried out by means of air doctor coating, blade coating, air knife coating, squeeze coating, impregnation coating, reverse-roll coating, transfer-roll coating, gravure coating, kiss coating, cast coating, spray coating, dip coating, bar coating, or extrusion coating, and the coating solution disclosed in JP-A-5-341436 is preferably used.

A magnetic recording layer may be provided with functions of lubrication improvement, curling adjustment, antistatic property, adhesion prevention and head abrasion, or another functional layer having these functions may be provided, and at least one kind or more of the grains are preferably abrasives of non-spherical inorganic grains having Mohs' hardness of 5 or more. The composition of the non-spherical inorganic grain is preferably oxide such as aluminum oxide, chromium oxide, silicon dioxide, titanium dioxide, silicon carbide, etc., carbide such as silicon carbide and titanium carbide, and fine powders such as diamond. The surface of these abrasives may be treated with a silane coupling agent or a titanium coupling agent. These grains may be added to a magnetic recording layer, or may be overcoated on a magnetic recording layer (e.g., a protective layer, a lubricating layer). The above described binders can be used at this time, preferably the same binders as the binder of the magnetic recording layer are used. Photographic materials having magnetic recording layers are disclosed in U.S. Pat. Nos. 5,336,589, 5,250,404, 5,229,259, 5,215,874 and European Patent 466130.

The polyester support for use in the present invention is described below, but details including photographic materials described later, processing, cartridges and examples are disclosed in Kokai-Giho, Kogi No. 94-6023 (Hatsumei-Kyokai, Mar. 15, 1994). The polyester for use in the present invention comprises diol and aromatic dicarboxylic acid as essential components, and as aromatic dicarboxylic acids, 2,6-, 1,5-, 1,4- and 2,7-naphthalenedicarbxoxylic acid, terephthalic acid, isophthalic acid, and phthalic acid, and as diols diethylene glycol, triethylene glycol, cyclohexanedimethanol, bisphenol A, and bisphenol can be enumerated. Polymerized polymers thereof include homopolymers such as polyethylene terephthalate, polyethylene naphthalate, polycyclohexanedimethanol terephthalate and the like. Particularly preferred is polyester comprising from 50 mol % to 100 mol % of 2,6-naphthalenedicarboxylic acid. Particularly preferred above all is polyethylene 2,6-naphthalate. The average molecular weight of them is about 5,000 to 200,000. Tg of the polyester for use in the present invention is 50° C. or more, and 90° C. or more is preferred.

The polyester support is heat treated at 40° C. or more and less than Tg, more preferably Tg minus 20° C. or more to less than Tg for the purpose of being reluctant to get curling habit. The heat treatment may be carried out at constant temperature within this range or may be carried out with cooling. The heat treatment time is from 0.1 hours to 1,500 hours, preferably from 0.5 hours to 200 hours. The heat treatment of the support may be carried out in a roll state or may be carried out in a web state while transporting. The surface of the support may be provided with concave and convex (e.g., coating conductive inorganic fine grains such as $SnO_2$ or $Sb_2O_5$) to improve the surface state. Further, it is desired to contrive so as to prevent cut end photographing of the core part by providing knurling at the end part and make only the end part a little high. The heat treatment may be carried out at any stage of after formation of the support, after the surface treatment, after coating of a backing layer (an antistatic agent, a sliding agent, etc.), or after undercoating, but preferably conducted after coating of an antistatic agent.

An ultraviolet absorbing agent may be incorporated into the polyester support. Further, light piping can be prevented by including the commercially available dye or pigment for polyester such as Diaresin manufactured by Mitsubishi Kasei Corp. or Kayaset manufactured by Nippon Kayaku Co., Ltd.

To ensure adhesion of the support and the constitutional layers of the photographic material, the surface activation treatment is preferably carried out, such as a chemical treatment, a mechanical treatment, a corona discharge treatment, a flame treatment, an ultraviolet treatment, a high frequency treatment, a glow discharge treatment, an active plasma treatment, a laser treatment, a mixed acid treatment, and an ozone oxidation treatment, and preferred of them are an ultraviolet irradiation treatment, a flame treatment, a corona discharge treatment, and a glow discharge treatment.

An undercoating method is described below. An undercoat layer may be a single layer or may be two or more layers. The binder for an undercoat layer include copolymers with monomers selected from vinyl chloride, vinylidene chloride, butadiene, methacrylic acid, acrylic acid, itaconic acid and maleic anhydride being starting materials, as well as polyethyleneimine, an epoxy resin, grafted gelatin, nitrocellulose and gelatin. Compounds which swell the support include resorcin and p-chlorophenol. A gelatin hardening agent for an undercoat layer include chromium salt (chrome alum), aldehydes (formaldehyde, glutaraldehyde), isocyanates, active halide compounds (2,4-dichloro-6-hydroxy-s-triazine), epichlorohydrin resins, and active vinyl sulfone compounds. $SiO_2$, $TiO_2$, inorganic fine grains or polymethyl methacrylate copolymer fine grains (0.01 to 10 μm) may be contained as a matting agent.

Further, antistatic agents are preferably used in the present invention. Examples of such antistatic agents include high polymers containing carboxylic acid and carboxylate, sulfonate, cationic polymer, and ionic surfactant compounds.

The most preferred antistatic agents are fine grains of a crystalline metal oxide of at least one grain selected from ZnO, $TiO_2$, $SnO_2$, $Al_2O_3$, $In_2O_3$, $SiO_2$, MgO, BaO, $MoO_3$ and $V_2O_5$ having a volume resistivity of $10^7\Omega$.cm or less, more preferably $10^5\Omega$.cm or less and having a grain size of from 0.001 to 1.0 μm or fine grains of composite oxides of them (Sb, P, B, In, S, Si, C), further, fine grains of a metal oxide in the form of sol or fine grains of these composite oxides. The addition amount to the photographic material is preferably from 5 to 500 mg/m$^2$ and particularly preferably from 10 to 350 mg/m$^2$. The ratio of the conductive crystalline oxides or composite oxides thereof to the binder is preferably from 1/300 to 100/1 and more preferably from 1/100 to 100/5.

It is preferred for the photographic material of the present invention to have a sliding property. The sliding agent-containing layer is preferably provided on both of light-sensitive layer surface and backing layer surface. Preferred sliding property is a dynamic friction coefficient of from 0.25 to 0.01. Measurement at this time is conducted using a stainless steel ball having a diameter of 5 mm at a transporting speed of 60 cm/min (25° C., 60% RH). In this evaluation, when the opposite material is replaced with the light-sensitive layer surface, almost the same level of value can be obtained.

Examples of the sliding agent which can be used in the present invention include polyorganosiloxane, higher fatty acid amide, higher fatty acid metal salt, higher resin acid and higher alcohol ester. As polyorganosiloxane, polydimethylsiloxane, polydiethylsiloxane, polystyrylmethylsiloxane, and polymethylphenylsiloxane can be used. The addition layer is preferably the outermost layer of the emulsion layer or a backing layer. In particular, polydimethylsiloxane or esters having a long chain alkyl group are preferred.

The photographic material of the present invention preferably contains a matting agent. The matting agent may be added to either of the emulsion layer side or the backing layer side but it is particularly preferably to be added to the outermost layer of the emulsion layer. The matting agent may be either soluble or insoluble in the processing solution, preferably both types are used in combination. For example, polymethyl methacrylate, poly(methyl methacrylate/methacrylic acid=9/1 or 5/5 (mol ratio)), and polystyrene grains are preferably used. The average grain size is preferably from 0.8 to 10 μm, and grain size distribution is preferably narrow, preferably 90% or more of the entire grain number accounts for 0.9 to 1.1 times of the average grain size. For increasing the matting property, fine grains having a grain size of 0.8 μm or less are preferably added at the same time. For example, polymethyl methacrylate (0.2 μm), poly(methyl methacrylate/methacrylic acid=9/1 (mol ratio), 0.3 μm), polystyrene grains (0.25 μm), and colloidal silica (0.03 μm) are enumerated.

The film patrone preferably used in the present invention is described below. The main material of the patrone for use in the present invention may be metal or synthetic plastics.

Preferred plastic materials are polystyrene, polyethylene, polypropylene, polyphenyl ether, etc. Further, the patrone for use in the present invention may contain various antistatic agents, and carbon black, metal oxide grains, nonionic, anionic, cationic and betaine based surfactants or polymers can be preferably used. Such a patrone static prevented is disclosed in JP-A-1-312537 and JP-A-1-312538. In particular, those having the resistivity of $10^{12}\Omega$ or less at 25° C., 25% RH are preferred. Usually, plastic patrone is produced using plastics including carbon black or a pigment to impart light shielding. The size of the patrone may be 135 size of the present as it is, or for miniaturizing a camera, it is effective that the diameter of the cartridge of 25 mm of the present 135 size may be decreased to 22 mm or less. The capacity of the case of the patrone is 30 cm$^3$ or less and preferably 25 cm$^3$ or less. The weight of the plastics used for the patrone and patrone case is preferably from 5 g to 15 g.

Further, the patrone may be a type of sending out the film by revolving a spool. Further, it may be the structure such that the tip of the film is encased in the body of the patrone and the tip of the film is sent to outside through the port of the patrone by revolving the axle of the spool in the feeding direction of the film. These are disclosed in U.S. Pat. Nos. 4,834,306 and 5,226,613. The photographic film for use in the present invention may be a so-called raw film before development or may be a photographic film development processed. Further, a raw film and a processed film may be contained in the same patrone, or may be stored in different patrones.

The present invention will be illustrated in more detail with reference to examples below, but these are not to be construed as limiting the invention.

EXAMPLE 1

1) Support

The support which was used in the present invention was prepared as follows.

100 weight parts of polyethylene-2,6-naphthalate polymer and 2 weight parts of Tinuvin P. 326 (product of Ciba Geigy), as an ultraviolet absorbing agent, were dried, then melted at 300° C., subsequently, extruded through a T-type die, and stretched 3.3 times in a machine direction at 140° C. and then 3.3 times in a transverse direction at 130° C., and further thermal fixed for 6 seconds at 250° C. and the PEN film having the thickness of 90 μm was obtained. Appropriate amounts of blue dyes, magenta dyes and yellow dyes were added to the starting material of the PEN film before the extrusion (I-1, I-4, I-6, I-24, I-26, I-27 and II-5 disclosed in Kokai-Giho, Kogi No. 94-6023). Further, the film was wound on to a stainless steel spool having a diameter of 20 cm and provided heat history at 110° C. for 48 hours to obtain a support reluctant to get curling habit.

2) Coating of undercoat layer

After both surfaces of the above support were subjected to corona discharge, UV discharge and glow discharge treatments, on one side of the support to provide a light-sensitive layer an undercoat solution having the following composition was coated (10 cc/m$^2$, using a bar coater): 0.1 g/m$^2$ of gelatin, 0.01 g/m$^2$ of sodium α-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of polyamide-epichlorohydrin polycondensation product. The undercoat layer was provided on the hotter side at the time of stretching. Drying was conducted at 115° C. for 6 minutes (the temperature of the roller and transporting device of the drying zone was 115° C.).

3) Coating of backing layer

On the other side of the above support after undercoat layer coating, an antistatic layer, a magnetic recording layer and a sliding layer having the following compositions were coated as backing layers.

3-1) Coating of antistatic layer 0.2 g/m$^2$ of a dispersion of fine grain powder of a stannic oxide-antimony oxide composite having the average grain size of 0.005 μm and specific resistance of 5 Ω.cm (the grain size of the second agglomerate: about 0.08 μm), 0.02 g/m$^2$ of gelatin, 0.009 g/m$^2$ of polyglycerol polyglycidyl ether, and 0.006 g/m$^2$ of polyoxyethylenesorbitanmonolaurate (polymerization degree: 20) were coated.

3-2) Coating of magnetic recording layer 0.06 g/m$^2$ of cobalt-γ-iron oxide which was coating-treated with 3-polyoxyethylenepropyloxytrimethoxysilane (polymerization degree: 15) (15 wt %) (specific surface area:43 m$^2$/g, major axis: 0.14 μm, minor axis: 0.03 μm, saturation magnetization: 89 emu/g, $Fe^{+2}/Fe^{+3}$ is 6/94, the surface was treated with 2 wt %, respectively, based on the iron oxide, of aluminum oxide and silicon oxide), 1.2 g/m$^2$ of diacetyl cellulose (dispersion of the iron oxide was carried out using an open kneader and a sand mill), 0.3 g/m$^2$ of $C_2H_5C[CH_2OCONH{-}C_6H_{13}(CH_3)NCO]_3$ as a curing agent, with acetone, methyl ethyl ketone and cyclohexanone as solvents, were coated with a bar coater to obtain a magnetic recording layer having the film thickness of 1.2 μm. As matting agents, silica grains (0.3 μm) and an aluminum oxide abrasive (0.15 μm) coating-treated with 3-polyoxyethylenepropyloxytrimethoxysilane (polymerization degree: 15) (15 wt %) were added each in an amount of 10 mg/m$^2$. Drying was conducted at 115° C. for 6 minutes (the temperature of the roller and transporting device of the drying zone was 115° C.). The increase of the color density of $D^B$ of the magnetic recording layer by X-light (a blue filter) was about 0.1, and saturation magnetization moment of the magnetic recording layer was 4.2 emu/g, coercive force was $7.3\times10^4$ A/m, and rectangular ratio was 65%.

3-3) Preparation of sliding layer

Diacetyl cellulose (25 mg/m$^2$), and a mixture of $C_6H_{13}CH(OH)C_{10}H_{20}COOC_{40}H_{81}$ (Compound a, 6 mg/m$^2$)/$C_{50}H_{101}O(CH_2CH_2O)_{16}H$ (Compound b, 9 mg/m$^2$) were coated. This mixture of Compound a/Compound b was dissolved in xylene/propylene monomethyl ether (1/1) by heating at 105° C., and poured into propylene monomethyl ether (10 time amount) at room temperature and dispersed, and further dispersed in acetone (average grain size: 0.01 μm), then added to the coating solution. As matting agents, silica grains (0.3 μm) and aluminum oxide (0.15 μm) coated with 3-polyoxyethylenepropyloxytrimethoxysilane abrasive (polymerization degree: 15) (15 wt %) were added each in an amount of 15 mg/m$^2$. Drying was conducted at 115° C. for 6 minutes (the temperature of the roller and transporting device of the drying zone was 115° C.). The thus-obtained sliding layer showed excellent performances of dynamic friction coefficient of 0.06 (a stainless steel hard ball of 5 mmφ, load: 100 g, speed: 6 cm/min), static friction coefficient of 0.07 (a clip method), and the sliding property with the surface of the emulsion described below provided dynamic friction coefficient of 0.12.

4) Coating of light-sensitive layer

Next, each layer having the following composition was multilayer coated on the opposite side of the above obtained backing layer and a color negative film was prepared as Sample No. 101.

Composition of Light-Sensitive Layer

The main components for use in each layer are classified as follows:

ExC: Cyan Coupler

ExM: Magenta Coupler

ExY: Yellow Coupler

ExS: Sensitizing Dye

UV: Ultraviolet Absorber

HBS: High Boiling Point Organic Solvent

H: Hardening Agent for Gelatin

The numeral corresponding to each component indicates the coated weight in unit of g/m$^2$, and the coated weight of silver halide is shown as the calculated weight of silver. Further, in the case of a sensitizing dye, the coated weight is indicated in unit of mol per mol of silver halide in the same layer.

| First Layer: Antihalation Layer | |
|---|---|
| Black Colloidal Silver | 0.09 as silver |
| Gelatin | 1.60 |

-continued

| | |
|---|---|
| ExM-1 | 0.12 |
| EXF-1 | $2.0 \times 10^{-3}$ |
| Solid Dispersion Dye ExF-2 | 0.030 |
| Solid Dispersion Dye ExF-3 | 0.040 |
| HBS-1 | 0.15 |
| HBS-2 | 0.02 |
| Second Layer: Interlayer | |
| Silver Iodobromide Emulsion M | 0.065 as silver |
| ExC-2 | 0.04 |
| Polyethyl Acrylate Latex | 0.20 |
| Gelatin | 1.04 |
| Third Layer: Low Sensitivity Red-Sensitive Emulsion Layer | |
| Silver Iodobromide Emulsion A | 0.30 as silver |
| Silver Iodobromide Emulsion B | 0.20 as silver |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.15 |
| ExC-3 | 0.030 |
| ExC-4 | 0.13 |
| ExC-5 | 0.020 |
| ExC-6 | 0.010 |
| Cpd-2 | 0.025 |
| HBS-1 | 0.15 |
| Gelatin | 0.87 |
| Fourth Layer: Middle Sensitivity Red-Sensitive Emulsion Layer | |
| Silver Iodobromide Emulsion C | 0.70 as silver |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.15 |
| ExC-2 | 0.050 |
| ExC-3 | 0.0070 |
| ExC-4 | 0.080 |
| ExC-5 | 0.015 |
| ExC-6 | 0.0070 |
| Cpd-2 | 0.023 |
| HBS-1 | 0.10 |
| Gelatin | 0.75 |
| Fifth Layer: High Sensitivity Red-Sensitive Emulsion Layer | |
| Silver Iodobromide Emulsion D | 1.40 as silver |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| Sixth Layer: Interlayer | |
| Cpd-1 | 0.090 |
| Solid Dispersion Dye ExF-4 | 0.030 |
| HBS-1 | 0.050 |
| Polyethyl Acrylate Latex | 0.15 |
| Gelatin | 1.10 |
| Seventh Layer: Low Sensitivity Green-Sensitive Emulsion Layer | |
| Silver Iodobromide Emulsion E | 0.10 as silver |
| Silver Iodobromide Emulsion F | 0.15 as silver |
| Silver Iodobromide Emulsion G | 0.10 as silver |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| Eighth Layer: Middle Sensitivity Green-Sensitive Emulsion Layer | |
| Silver Iodobromide Emulsion H | 0.80 as silver |

-continued

| | |
|---|---|
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.12 |
| ExM-3 | 0.025 |
| ExY-1 | 0.022 |
| ExY-4 | 0.015 |
| ExY-5 | 0.033 |
| HBS-1 | 0.15 |
| HBS-3 | $4.0 \times 10^{-3}$ |
| Gelatin | 0.80 |
| Ninth Layer: High Sensitivity Green-Sensitive Emulsion Layer | |
| Silver Iodobromide Emulsion I | 1.25 as silver |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.035 |
| ExM-5 | 0.035 |
| Cpd-3 | 0.040 |
| HBS-1 | 0.25 |
| Polyethyl Acrylate Latex | 0.15 |
| Gelatin | 1.33 |
| Tenth Layer: Yellow Filter Layer | |
| Yellow Colloidal Silver | 0.015 as silver |
| Cpd-1 | 0.16 |
| Solid Dispersion Dye ExF-5 | 0.060 |
| Solid Dispersion Dye ExF-6 | 0.060 |
| Oil-Soluble Dye ExF-7 | 0.010 |
| HBS-1 | 0.60 |
| Gelatin | 0.60 |
| Eleventh Layer: Low Sensitivity Blue-Sensitive Emulsion Layer | |
| Silver Iodobromide Emulsion J | 0.11 as silver |
| Silver Iodobromide Emulsion K | 0.07 as silver |
| ExS-7 | $8.6 \times 10^{-4}$ |
| ExC-8 | $7.0 \times 10^{-3}$ |
| ExY-1 | 0.050 |
| ExY-2 | 0.32 |
| ExY-3 | 0.40 |
| ExY-4 | 0.020 |
| Cpd-2 | 0.10 |
| Cpd-3 | $4.0 \times 10^{-3}$ |
| HBS-1 | 0.30 |
| Gelatin | 1.20 |
| Twelfth Layer: High Sensitivity Blue-Sensitive Emulsion Layer | |
| Silver Iodobromide Emulsion L | 1.00 as silver |
| ExS-7 | $4.0 \times 10^{-4}$ |
| ExY-2 | 0.08 |
| ExY-3 | 0.12 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| Thirteenth Layer: First Protective Layer | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.8 |
| Fourteenth Layer: Second Protective Layer | |
| Silver Iodobromide Emulsion M | 0.10 as silver |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

Further, W-1 to W-3, B-4 to B-6, F-1 to F-17, iron salt, lead salt, gold salt, platinum salt, palladium salt, iridium salt and rhodium salt were appropriately included in each layer to improve storage stability, processing properties, pressure resistance, fungicidal and biocidal properties, antistatic properties and coating properties.

TABLE 1

| Emulsion | Average AgI Content (%) | Variation Coefficient of the AgI Content among Grains (%) | Average Diameter Corresponding to Sphere (μm) | Variation Coefficient of the Grain Size (%) | Projected Area Diameter Corresponding to Circle (μm) | Diameter/ Thickness Ratio |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.4 |
| G | 8.8 | 25 | 0.61 | 23 | 0.77 | 4.7 |
| H | 8.8 | 25 | 0.61 | 23 | 0.77 | 4.0 |
| I | 8.9 | 18 | 0.84 | 26 | 1.03 | 4.0 |
| J | 1.7 | 10 | 0.4& | 15 | 0.50 | 4.4 |
| K | 8.8 | 18 | 0.64 | 23 | 0.85 | 5.5 |
| L | 14.0 | 25 | 1.28 | 26 | 1.46 | 3.5 |
| M | 1.0 | — | 0.07 | 15 | — | 1 |

In Table 1

(1) Emulsions J, K and L were reduction sensitized during preparation of the grains using thiourea dioxide and thiosulfonic acid according to the examples of JP-A-2-191938 (corresponding to U.S. Pat. No. 5,061,614).

(2) Emulsions A to I were gold, sulfur, and selenium sensitized, respectively, in the presence of the spectral sensitizing dyes which are described at each light-sensitive layer and sodium thiocyanate according to the examples of JP-A-3-237450 (corresponding to EP-A-443453).

(3) Low molecular weight gelatin was used in the preparation of the tabular grains according to the examples of JP-A-1-158426.

(4) In tabular grains, there were observed such dislocation lines as disclosed in JP-A-3-237450 (corresponding to EP-A-443453), using a high pressure electron microscope.

(5) Emulsion L comprised double structure grains containing an internal high iodide core as disclosed in JP-A-60-143331.

Preparation of Dispersion of Organic Solid Dispersion Dye

ExF-3 shown below was dispersed according to the following method. That is, water and 200 g of Pluronic F88 (ethylene oxide/propylene oxide block copolymer) manufactured by BASF Co. were added to 1,430 g of a wet cake of the dye containing 30% of methanol, and stirred to obtain a slurry having 6% dye concentration. Next, 1,700 ml of zirconia beads having an average diameter of 0.5 mm were filled in an ultravisco mill (UVM-2) manufactured by Imex Co., the slurry was passed and the content was pulverized at a peripheral speed of about 10 m/sec and discharge amount of 0.5 l/min for 8 hours. Beads were removed by filtration, water was added to dilute the dispersion to dye concentration of 3%, then heated at 90° C. for 10 hours for stabilization. The average grain size of the obtained fine grains of the dye was 0.60 μm and the extent of distribution of grain sizes (standard deviation of grain sizes×100/average grain size) was 18%.

Solid dispersions of ExF-4, ExF-5 and ExF-6 were obtained in the same manner. The average grain sizes of fine grains of the dyes were 0.45 μm, 0.54 μm and 0.52 μm, respectively. ExF-2 was dispersed according to the micro-precipitation dispersion method by pH shift disclosed in the example of JP-A-3-182743. The average grain size of fine grains of the dye was 0.05 μm.

ExC-1

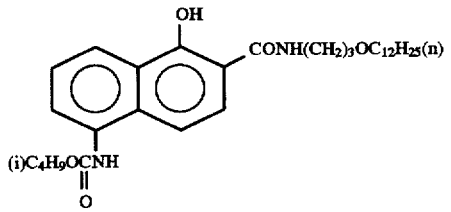

-continued
ExC-2
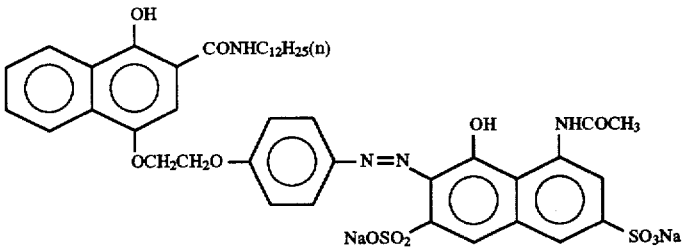
ExC-3
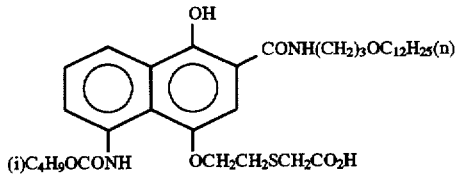
ExC-4
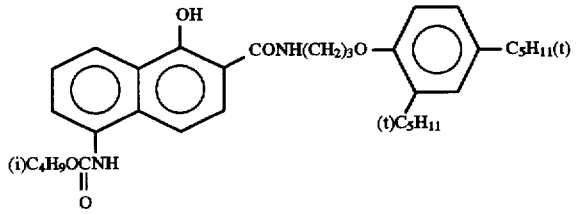
ExC-5
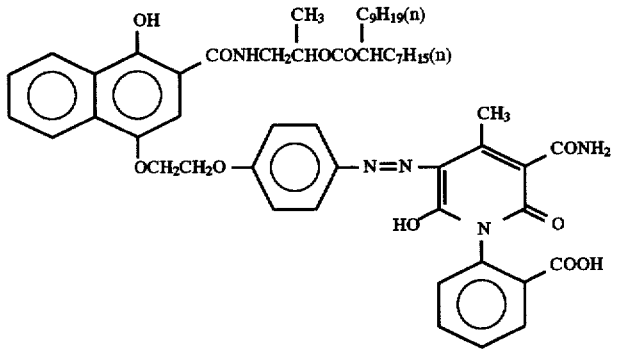
ExC-6
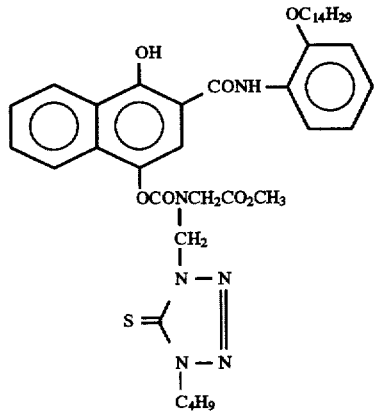
ExC-7
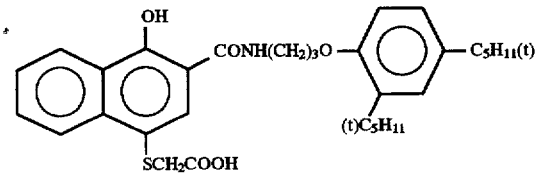

-continued
ExC-8
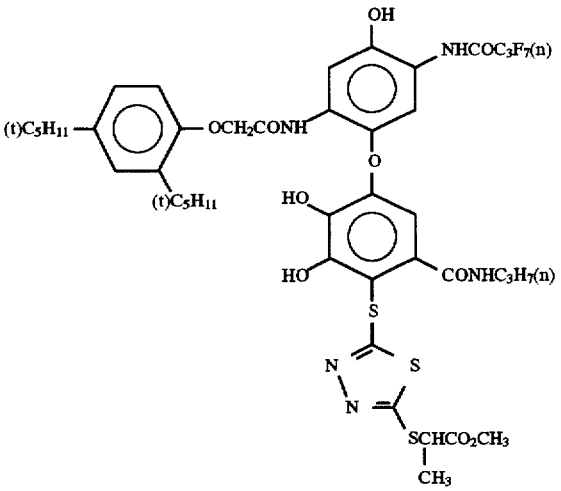
ExM-1
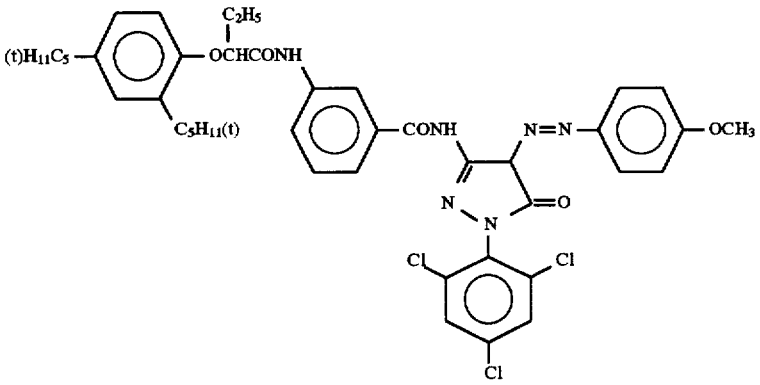
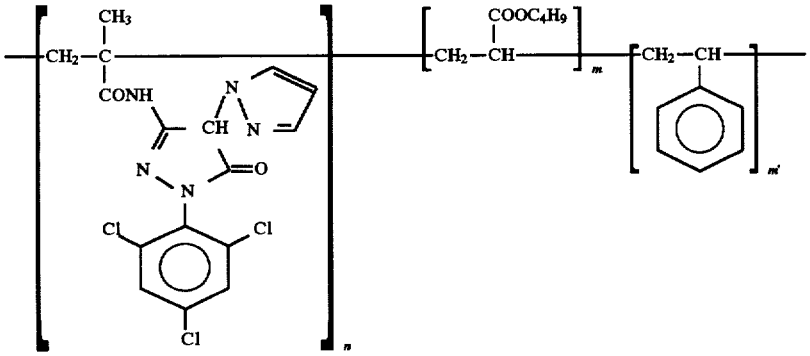
n = 50 (mol %)
m = 25 (mol %)
m' = 25 (mol %)
mol. wt. = about 20,000

-continued
ExM-3
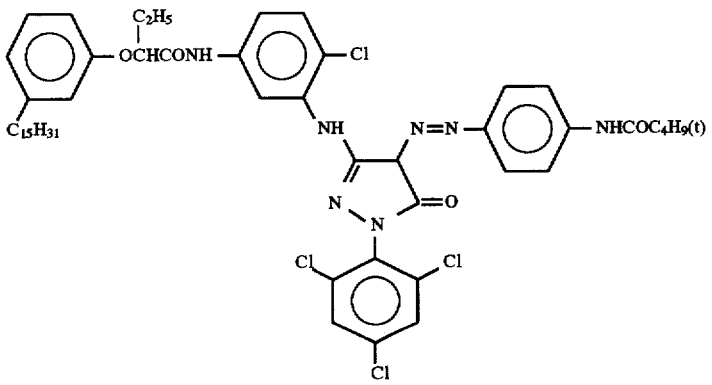
ExM-4
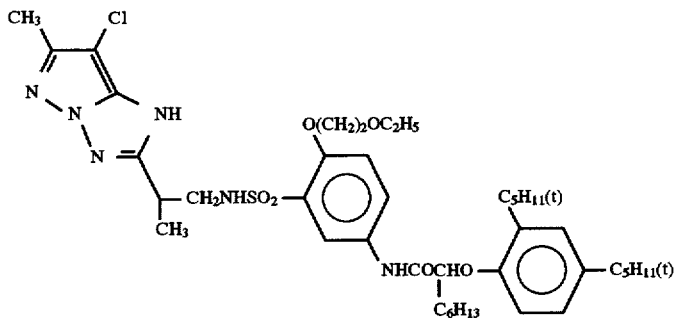
ExM-5
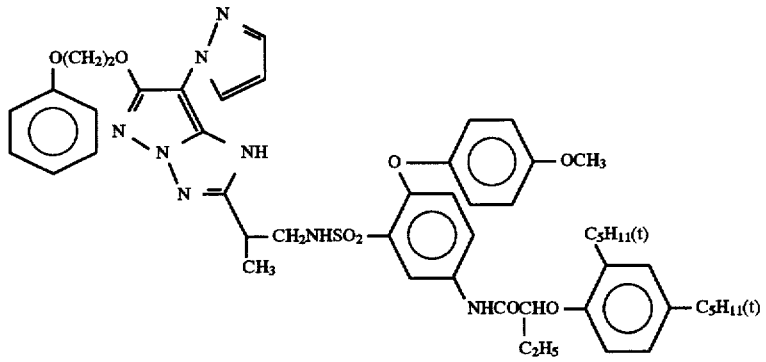
ExY-1
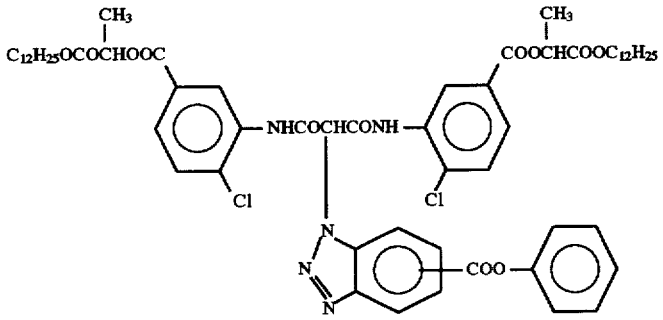

-continued
ExY-2
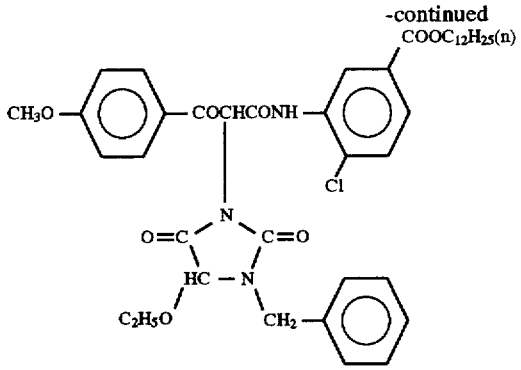
ExY-3
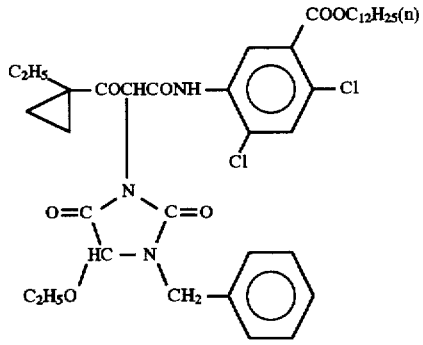
ExY-4
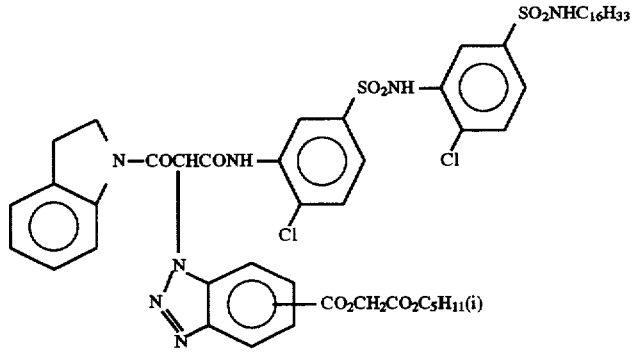
ExY-5
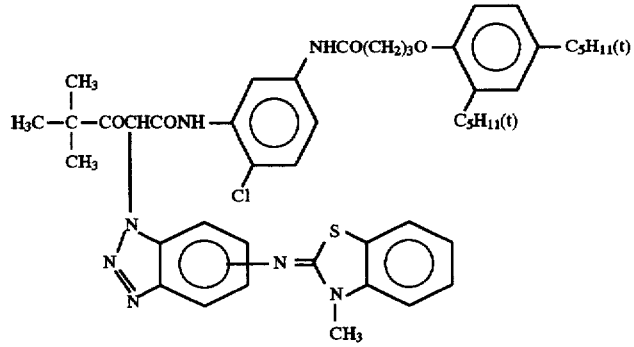
ExF-1
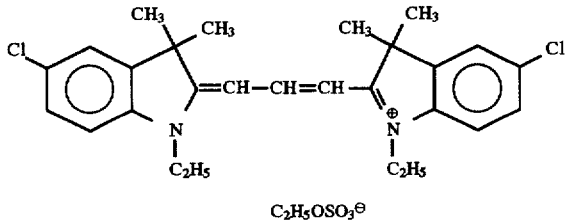

-continued
ExF-2
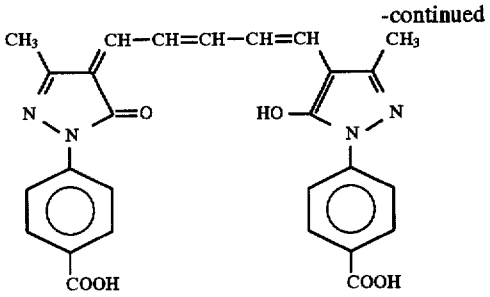
ExF-3
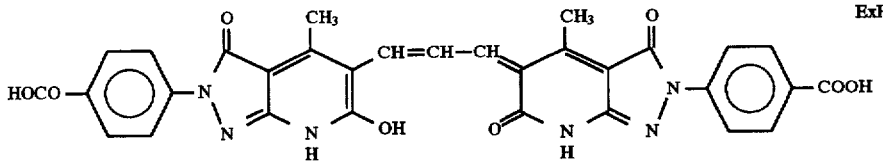
ExF-4
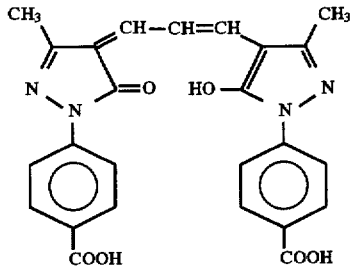
ExF-5
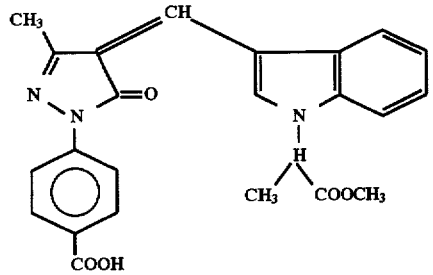
ExF-6
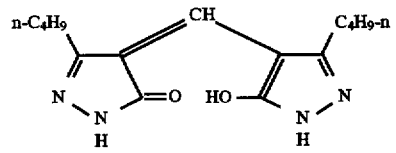
ExF-7
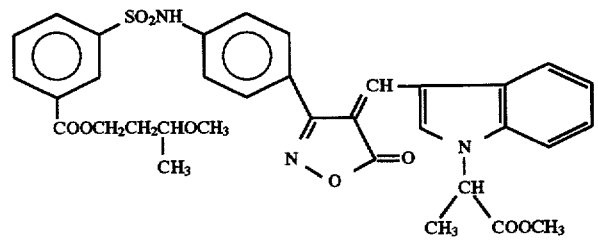
Cpd-1
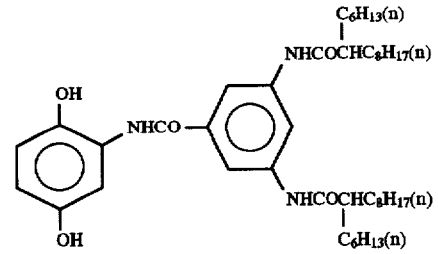

-continued
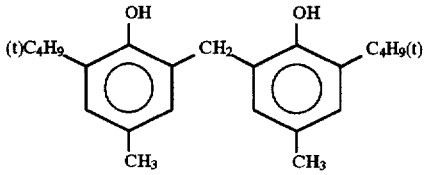
Cpd-2
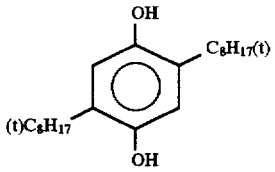
Cpd-3
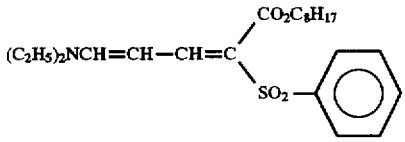
UV-1
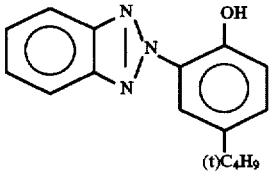
UV-2
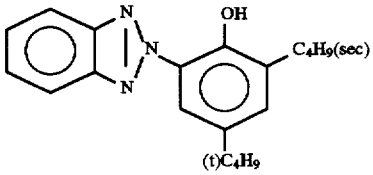
UV-3
Tricresyl phosphate HBS-1
Di-n-butyl phthalate HBS-2
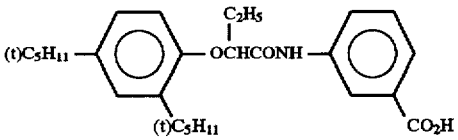
HBS-3
Tri(2-ethylhexyl) phosphate HBS-4
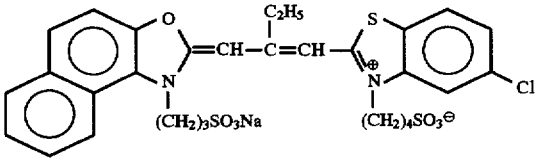
ExS-1
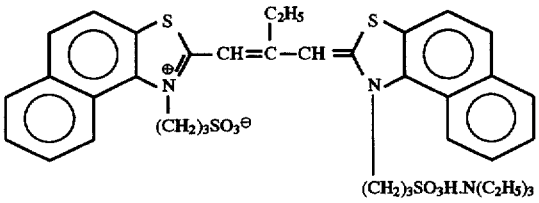
ExS-2

-continued
ExS-3
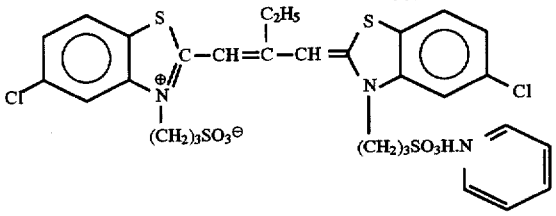
ExS-4
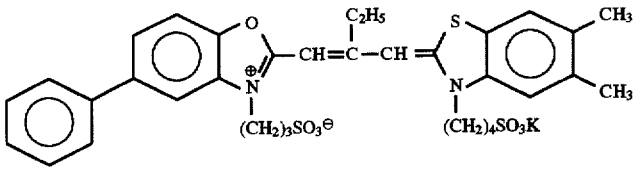
ExS-5
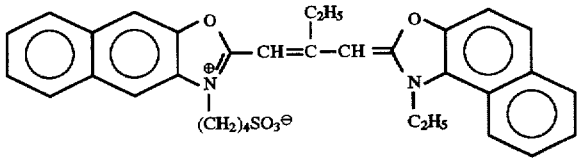
ExS-6
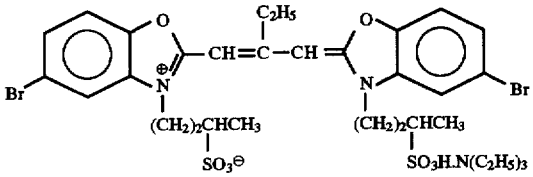
ExS-7
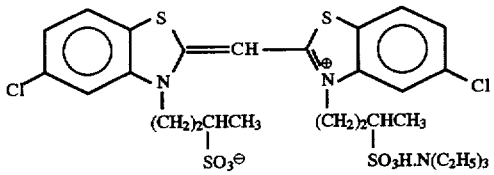
S-1
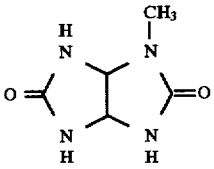
H-1
$CH_2{=}CH{-}SO_2{-}CH_2{-}CONH{-}CH_2$
$CH_2{=}CH{-}SO_2{-}CH_2{-}CONH{-}CH_2$
B-1
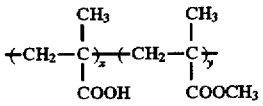
x/y = 10/90 (weight ratio)
average molecular weight:
about 35,000
B-2
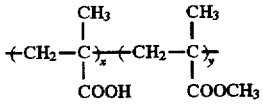
x/y = 40/60 (weight ratio)
average molecular weight:
about 20,000
B-3
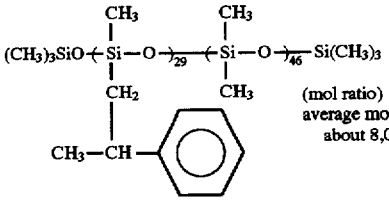
(mol ratio)
average molecular weight:
about 8,000

-continued
B-4
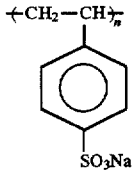
average molecular weight:
about 750,000
B-5
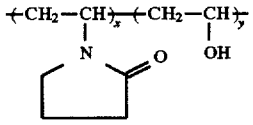
x/y = 70/30 (mol ratio)
average molecular weight:
about 17,000
B-6
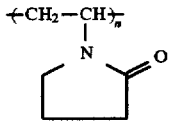
average molecular weight:
about 10,000
(n = an integer)
W-1
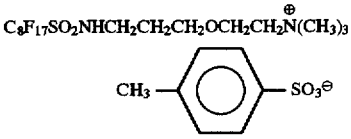
W-2
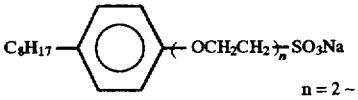
n = 2 ~ 4
W-3
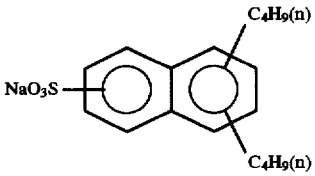
F-1
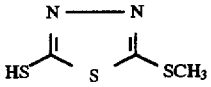
F-2
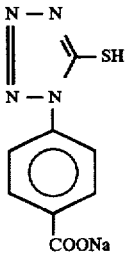
F-3
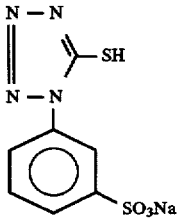
F-4
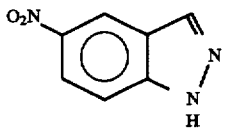

-continued
F-5
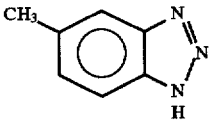
F-6
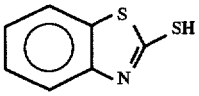
F-7
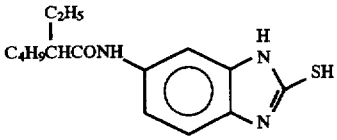
F-8
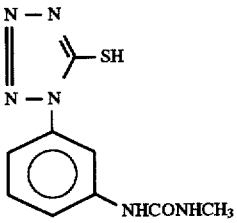
F-9
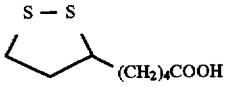
F-10
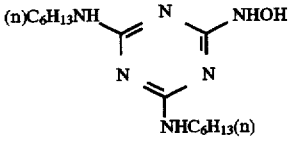
F-11
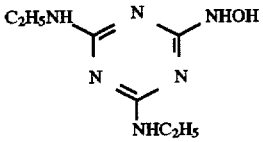
F-12
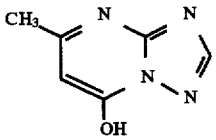
F-13
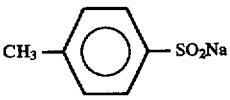
F-14
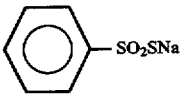
F-15
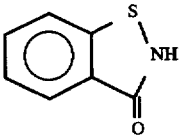
F-16
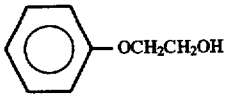

-continued

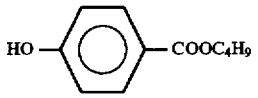

Comparative Compound a

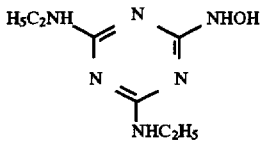

The thus prepared photographic material was cut to a size of 24 mm in width and 160 cm in length, and two perforations of 2 mm square at an interval of 5.8 mm were provided 0.7 mm inside from one side width direction in the length direction of the photographic material. The sample provided with this set of two perforations at intervals of 32 mm was prepared and encased in the plastic film cartridge explained in FIG. 1 to FIG. 7 in U.S. Pat. No. 5,296,887.

FM signals were recorded between the above perforations of the sample from the side of the support having the magnetic recording layer using a head capable of in and out of 2,000 turns with head gap of 5 μm at a feed rate of 1,000/s.

After FM signals were recorded, the emulsion surface was subjected to entire and uniform exposure of 1,000 cms and each process was conducted according to the following methods, and each sample was put in the above plastic film cartridge again.

Preparation of Sample No. 102

Sample No. 102 was prepared in the same manner as the preparation of Sample No. 101 except that Compound A-50 according the present invention was added as shown in Table 2.

Preparation of Sample Nos. 103 and 104

Sample Nos. 103 and 104 were prepared in the same manner as the preparation of Sample No. 102 except for replacing Compound Cpd-1 in the sixth layer and the tenth layer with the compounds shown in Table 2 each in one time molar amount.

Preparation of Sample Nos. 105 and 106

Sample Nos. 105 and 106 were prepared in the same manner as the preparation of Sample No. 101 except for replacing Compound Cpd-1 in the sixth layer and the tenth layer with the compounds shown in Table 2 each in one time molar amount.

Preparation of Sample Nos. 107 to 110

Sample Nos. 107 to 110 were prepared in the same manner as the preparation of Sample No. 105 except that the compounds according to the present invention were added as shown in Table 2.

Preparation of Sample Nos. 111 and 112

Sample Nos. 111 and 112 were prepared in the same manner as the preparation of Sample No. 109 except for replacing Compound H-3 in the sixth layer and the tenth layer with the compounds shown in Table 2 each in one time molar amount.

Preparation of Sample No. 113

Sample No. 113 was prepared in the same manner as the preparation of Sample No. 107 except for replacing Compound A-3 with Comparative Compound a in equal weight as shown in Table 2.

F-17

TABLE 2

| | Compound according to the Invention | | | |
|---|---|---|---|---|
| Sample No. | Kind | Addition Layer | Amount Added (g/m²) | Compound in 6th and 10th Layers |
| 101 | — | — | — | Cpd-1 |
| 102 | A-50 | 12th layer | 0.02 | Cpd-1 |
| 103 | A-50 | " | 0.02 | Cpd-3 |
| 104 | A-50 I | " | 0.02 | H-3 |
| 105 | — | — | — | H-3 |
| 106 | — | — | — | Cpd-3 |
| 107 | A-3 V | 1st to 14th layers | 0.03 | H-3 |
| 108 | A-49 I | 12th layer | 0.02 | H-3 |
| 109 | A-55 I | " | 0.02 | H-3 |
| 110 | A-55 | 12th layer | 0.02 | H-3 |
| | A-3 | 1st to 14th layers | 0.03 | |
| 111 | A-55 | 12th layer | 0.02 | H-21 |
| 112 | A-55 | " | 0.02 | H-12 |
| 113 | Comparative Compound a | 1st to 14th layers | 0.03 | H-3 |

Evaluation of fluctuation in photographic characteristics from photographing until development processing After each sample was wedgewise exposed by white light, one sample was allowed to stand under conditions of 45° C., 60% RH for 14 days, and the other was stored in a freezer, then each sample was development processed according to the following processing step.

With each sample, the change of the density at the exposure amount of the yellow image of the sample stored in a freezer giving the density of minimum density+1.0 was compared, and (the density of the sample stored at 45° C.) minus (minimum density+1.0) was determined and this was taken as the criterion of the evaluation of fluctuation in photographic characteristics from photographing until development processing of a photographic material. The smaller the value, the smaller is the fluctuation in photographic characteristics from photographing until development processing.

Evaluation of pressure resistance

After each sample was allowed to stand for 3 hours or more under conditions of 55% RH, the emulsion surface was scratched with a needle of 0.1 mmϕ with applying a load of 5 g at a speed of 1 cm/sec in the same atmosphere. This sample was processed according to the same processing step as above. The difference in densities of the non-pressured part and pressured part of the yellow image was taken as a criterion of the evaluation of pressure resistance as fog at pressured part.

Evaluation of fog with the lapse of time

One of each sample was allowed to stand at 50° C., 60% RH for 7 days and the other was stored in a freezer and subjected to the same exposure and development processing as above, and fog with the lapse of time was evaluated by the difference in minimum densities of the blue-sensitive layer.

The results obtained are shown in Table 3.

TABLE 3

| Sample No. | Fluctuation in Photographic Characteristics from Exposure to Development Processing | Change in Fog due to Storage | Pressure Resistance (fog density) |
|---|---|---|---|
| 101 (Comparison) | +0.12 | +0.11 | +0.24 |
| 102 (Comparison) | +0.05 | +0.06 | +0.21 |
| 103 (Comparison) | +0.05 | +0.06 | +0.21 |
| 104 (Invention) | +0.01 | +0.01 | +0.11 |
| 105 (Comparison) | +0.09 | +0.07 | +0.25 |
| 106 (Comparison) | +0.13 | +0.14 | +0.26 |
| 107 (Invention) | +0.04 | +0.02 | +0.13 |
| 108 (Invention) | +0.02 | +0.02 | +0.12 |
| 109 (Invention) | +0.02 | +0.02 | +0.12 |
| 110 (Invention) | +0.01 | +0.01 | +0.09 |
| 111 (Invention) | +0.02 | +0.02 | +0.11 |
| 112 (Invention) | +0.02 | +0.02 | +0.11 |
| 113 (Invention) | t0.06 | +0.06 | +0.18 |

It is understood from Table 3 that fluctuation in photographic characteristics from exposure until development processing and the change in fog due to storage are small and pressure resistance is improved using the compound according to the present invention. In particular, the combined use with the hydrazine based compound according to the present invention is preferred from the point of pressure resistance. Also, as is understood from the comparison of Sample Nos. 107 and 110, when hydroxylamine based compounds are used, combined use of water-soluble and oil-soluble compounds are further preferred.

Each processing was conducted using an automatic processor FP-360B manufactured by Fuji Photo Film Co., Ltd. according to the following step. Further, the processor was modified so that the overflow from the bleaching bath was discharged to the waste solution tank not to flow to the after bath. FP-360B processor carried the evaporation correcting means disclosed in Hatsumei Kyokai Kokai Giho 94-992.

The processing step and the composition of each processing solution are shown below.

Processing Step

| Step | Processing Time | Processing Temperature (°C.) | Replenishment Rate* (ml) | Tank Capacity (liter) |
|---|---|---|---|---|
| Color Development | 3 min 5 sec | 37.8 | 20 | 11.5 |
| Bleaching | 50 sec | 38.0 | 5 | 5 |
| Fixing (1) | 50 sec | 38.0 | — | 5 |
| Fixing (2) | 50 sec | 38.0 | 8 | 5 |
| Washing | 30 sec | 38.0 | 17 | 3 |
| Stabilization (1) | 20 sec | 38.0 | — | 3 |
| Stabilization (2) | 20 sec | 38.0 | 15 | 3 |
| Drying | 1 min 30 sec | 60 | | |

*Replenishment rate: per 1.1 meter of 35 mm wide photographic material (corresponding to a 24 Ex. film)

Stabilization and fixation were conducted in a countercurrent system from (2) to (1), and the overflow from the washing tank was all introduced into the fixing tank (2). Further, the amount of carryover of the developing solution into the bleaching step, the amount of carryover of the bleaching solution to the fixing step, and the amount of carryover of the fixing solution to the washing step were 2.5 ml, 2.0 ml and 2.0 ml per 1.1 meter of 35 mm wide photographic material, respectively. Further, the crossover time was 6 seconds in each case, and this time is included in the processing time of the previous step.

Open areas of the above processor were 100 $cm^2$ with the color developing solution, 120 $cm^2$ with the bleaching solution and about 100 $cm^2$ with each of other processing solutions.

The composition of each processing solution is described below.

| | Tank Solution (g) | Replenisher (g) |
|---|---|---|
| Color Developing Solution | | |
| Diethylenetriaminepentaacetic Acid | 3.0 | 3.0 |
| Disodium Catechol-3,5-disulfonate | 0.3 | 0.3 |
| Sodium Sulfite | 3.9 | 5.3 |
| Potassium Carbonate | 39.0 | 39.0 |
| Disodium N,N-Bis(2-sulfonato-ethyl)hydroxylamine | 1.5 | 2.0 |
| Potassium Bromide | 1.3 | 0.3 |
| Potassium Iodide | 1.3 mg | — |
| 4-Hydroxy-6-methyl-1,3,3a,7-tetraazaindene | 0.05 | — |
| Hydroxylamine Sulfate | 2.4 | 3.3 |
| 2-Methyl-4-[N-ethyl-N-(β-hydroxy-ethyl)amino]aniline Sulfate | 4.5 | 6.5 |
| Water to make | 1.0 l | 1.0 l |
| pH (adjusted with potassium hydroxide and sulfuric acid) | 10.05 | 10.18 |
| Bleaching Solution | | |
| Ammonium 1,3-Diaminopropanetetra-acetato Ferrate Monohydrate | 113 | 170 |
| Ammonium Bromide | 70 | 105 |
| Ammonium Nitrate | 14 | 21 |
| Succinic Acid | 34 | 51 |
| Maleic Acid | 28 | 42 |
| Water to make | 1.0 l | 1.0 l |
| pH (adjusted with aqueous ammonia) | 4.6 | 4.0 |

Fixing (1) Tank Solution

The mixed solution of 5/95 mixture (volume ratio) of the above bleaching tank solution and the following fixing tank solution (pH: 6.8)

| Fixing (2) Tank Solution | Tank Solution (g) | Replenisher (g) |
|---|---|---|
| Aqueous Ammonium Thiosulfate Solution (750 g/liter) | 240 ml | 727 ml |
| Imidazole | 7 | 20 |
| Ammonium Methanethiosulfonate | 5 | 15 |
| Ammonium Methanesulfinate | 10 | 30 |
| Ethylenediaminetetraacetic Acid | 13 | 39 |
| Water to make | 1.0 l | 1.0 l |
| pH (adjusted with aqueous ammonia and acetic acid) | 7.4 | 7.45 |

Washing Water

City water was passed through a mixed bed column packed with an H-type strongly acidic cation exchange resin (Amberlite IR-120B of Rohm & Haas) and an OH-type strongly basic anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 150 mg/liter of sodium sulfate were added thereto. The pH of this washing water was in the range of from 6.5 to 7.5.

| Stabilizing Solution (replenisher equals tank solution) | (unit: g) |
|---|---|
| Sodium p-Toluenesulfinate | 0.03 |
| Polyoxyethylene-p-monononylphenyl Ether (average polymerization degree: 10) | 0.2 |
| Sodium 1,2-Benzisothiazolin-3-one | 0.10 |
| Disodium Ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 l |
| pH | 8.5 |

EXAMPLE 2

Preparation of Sample No. 201

Sample No. 201 was prepared in the same manner as the preparation of Sample No. 105 in Example 1 except that Compound A-50 was added to the eighth layer and the ninth layer in an amount of 2 mol % based on the coating amount of silver in each layer.

Preparation of Sample No. 202

Sample No. 202 was prepared in the same manner as the preparation of Sample No. 201 except for replacing Compound A-50 in the eighth layer and the ninth layer with Compound A-55 in one time molar amount.

Preparation of Sample No. 203

Sample No. 203 was prepared in the same manner as the preparation of Sample No. 201 except that Compound A-3 was added to the first to fourteenth layers in total amount of 0.015 g/m$^2$.

The thus-prepared Sample Nos. 201 to 203 were evaluated in the same manner as in Example 1. The density measurement was evaluated by a magenta image in this Example.

As a result, the same excellent photographic characteristics as in Example 1 could be obtained.

EXAMPLE 3

Preparation of Sample No. 301

Each layer having the following composition was multilayer coated on the opposite side of the backing layer obtained in Sample No. 101 and a multilayer color photographic material was prepared. This sample was designated Sample No. 301. The numeral corresponding to each component indicates the addition amount per m$^2$. The function of the compounds added is not limited to the use described.

| First Layer: Antihalation Layer | |
|---|---|
| Black Colloidal Silver | 0.20 g |
| Gelatin | 1.90 g |
| Ultraviolet Absorbing Agent U-1 | 0.10 g |
| Ultraviolet Absorbing Agent U-3 | 0.040 g |
| Ultraviolet Absorbing Agent U-4 | 0.10 g |
| High Boiling Point Organic Solvent Oil-1 | 0.10 g |
| Microcrystal Solid Dispersion of Dye E-1 | 0.10 g |
| **Second Layer: Interlayer** | |
| Gelatin | 0.40 g |
| Compound Cpd-C | 5.0 mg |
| Compound Cpd-J | 5.0 mg |
| Compound Cpd-K | 3/0 mg |

-continued

| | | |
|---|---|---|
| High Boiling Point Organic Solvent Oil-3 | | 0.10 g |
| Dye D-4 | | 0.80 mg |
| **Third Layer: Interlayer** | | |
| Surface and Interior Fogged Fine Grain Silver Iodobromide Emulsion (average grain size: 0.06 μm, variation coefficient: 18%, AgI content: 1 mol %) | silver amount: | 0.050 g |
| Yellow Colloidal Silver | silver amount: | 0.030 g |
| Gelatin | | 0.40 g |
| **Fourth Layer: Low Sensitivity Red-Sensitive Emulsion Layer** | | |
| Emulsion A | silver amount: | 0.25 g |
| Emulsion B | silver amount: | 0.25 g |
| Gelatin | | 0.80 g |
| Coupler C-1 | | 0.15 g |
| Coupler C-2 | | 0.050 g |
| Coupler C-3 | | 0.050 g |
| Coupler C-9 | | 0.050 g |
| Compound Cpd-C | | 5.0 mg |
| Compound Cpd-J | | 5.0 mg |
| High Boiling Point Organic Solvent Oil-2 | | 0.20 g |
| Additive P-1 | | 0.10 g |
| **Fifth Layer: Middle Sensitivity Red-Sensitive Emulsion Layer** | | |
| Emulsion B | silver amount: | 0.20 g |
| Emulsion C | silver amount: | 0.30 g |
| Gelatin | | 0.80 g |
| Coupler C-1 | | 0.20 g |
| Coupler C-2 | | 0.050 g |
| Coupler C-3 | | 0.20 g |
| High Boiling Point Organic Solvent Oil-2 | | 0.05 g |
| Additive P-1 | | 0.10 g |
| **Sixth Layer: High Sensitivity Red-Sensitive Emulsion Layer** | | |
| Emulsion D | silver amount: | 0.40 g |
| Gelatin | | 1.10 g |
| Coupler C-1 | | 0.20 g |
| Coupler C-2 | | 0.20 g |
| Coupler C-3 | | 0.70 g |
| Additive P-1 | | 0.10 g |
| **Seventh Layer: Interlayer** | | |
| Gelatin | | 0.60 g |
| Additive M-1 | | 0.30 g |
| Color Mixing Preventive Cpd-I | | 2.6 mg |
| Dye D-5 | | 0.020 g |
| Dye D-6 | | 0.010 g |
| Compound Cpd-J | | 5.0 mg |
| High Boiling Point Organic Solvent Oil-1 | | 0.020 g |
| **Eighth Layer: Interlayer** | | |
| Surface and Interior Fogged Silver Iodobromide Emulsion (average grain size: 0.06 μm, variation coefficient: 16%, AgI content: 0.3 mol %) | silver amount: | 0.020 g |
| Yellow Colloidal Silver | silver amount: | 0.020 g |
| Gelatin | | 1.00 g |
| Additive P-1 | | 0.20 g |
| Color Mixing Preventive Cpd-A | | 0.20 g |
| **Ninth Layer: Low Sensitivity Green-Sensitive Emulsion Layer** | | |
| Emulsion E | silver amount: | 0.20 g |
| Emulsion F | silver amount: | 0.10 g |
| Emulsion G | silver amount: | 0.20 g |
| Gelatin | | 0.50 g |
| Coupler C-4 | | 0.08 g |
| Coupler C-7 | | 0.04 g |
| Coupler C-8 | | 0.25 g |
| Compound Cpd-B | | 0.030 g |
| Compound Cpd-D | | 0.020 g |
| Compound Cpd-E | | 0.020 g |
| Compound Cpd-F | | 0.040 g |
| Compound Cpd-J | | 10 mg |
| High Boiling Point Organic Solvent Oil-1 | | 0.25 g |
| High Boiling Point Organic Solvent Oil-2 | | 0.10 g |

-continued

| | | |
|---|---|---|
| Tenth Layer: Middle Sensitivity Green-Sensitive Emulsion Layer | | |
| Emulsion G | silver amount: | 0.15 g |
| Emulsion H | silver amount: | 0.25 g |
| Gelatin | | 0.60 g |
| Coupler C-4 | | 0.10 g |
| Coupler C-7 | | 0.20 g |
| Coupler C-8 | | 0.10 g |
| Compound Cpd-B | | 0.030 g |
| Compound Cpd-D | | 0.020 g |
| Compound Cpd-E | | 0.020 g |
| Compound Cpd-F | | 0.050 g |
| High Boiling Point Organic Solvent Oil-2 | | 0.010 g |
| Eleventh Layer: High Sensitivity Green-Sensitive Emulsion Layer | | |
| Emulsion I | silver amount: | 0.50 g |
| Gelatin | | 1.00 g |
| Coupler C-4 | | 0.33 g |
| Coupler C-7 | | 0.12 g |
| Coupler C-8 | | 0.05 g |
| Compound Cpd-B | | 0.080 g |
| Compound Cpd-E | | 0.020 g |
| Compound Cpd-F | | 0.040 g |
| Compound Cpd-K | | 5.0 mg |
| High Boiling Point Organic Solvent Oil-1 | | 0.020 g |
| High Boiling Point Organic Solvent Oil-2 | | 0.020 g |
| Twelfth Layer: Interlayer | | |
| Gelatin | | 0.60 g |
| Compound Cpd-C | | 0.050 g |
| High Boiling Point Organic Solvent Oil-1 | | 0.050 g |
| Thirteenth Layer: Yellow Filter Layer | | |
| Yellow Colloidal Silver | silver amount: | 0.070 g |
| Gelatin | | 1.10 g |
| Color Mixing Preventive Cpd-A | | 0.010 g |
| High Boiling Point Organic Solvent Oil-1 | | 0.010 g |
| Microcrystal Solid Dispersion of Dye E-2 | | 0.050 g |
| Fourteenth Layer: Interlayer | | |
| Gelatin | | 0.60 g |
| Fifteenth Layer: Low Sensitivity Blue-Sensitive Emulsion Layer | | |
| Emulsion J | silver amount: | 0.20 g |
| Emulsion K | silver amount: | 0.30 g |
| Gelatin | | 0.80 g |
| Coupler C-5 | | 0.20 g |
| Coupler C-6 | | 0.10 g |
| Coupler C-10 | | 0.40 g |
| Sixteenth Layer: Middle Sensitivity Blue-Sensitive Emulsion Layer | | |
| Emulsion L | silver amount: | 0.20 g |
| Emulsion M | silver amount: | 0.40 g |
| Gelatin | | 0.90 g |
| Coupler C-5 | | 0.10 g |
| Coupler C-6 | | 0.10 g |
| Coupler C-10 | | 0.60 g |
| Seventeenth Layer: High Sensitivity Blue-sensitive Emulsion Layer | | |
| Emulsion N | silver amount: | 0.15 g |
| Emulsion 0 | silver amount: | 0.25 g |
| Gelatin | | 1.20 g |
| Coupler C-5 | | 0.10 g |
| Coupler C-6 | | 0.10 g |
| Coupler C-10 | | 0.60 g |
| High Boiling Point Organic Solvent Oil-2 | | 0.10 g |
| Eighteenth Layer: First Protective Layer | | |
| Gelatin | | 0.70 g |
| Ultraviolet Absorbing Agent U-1 | | 0.20 g |
| Ultraviolet Absorbing Agent U-2 | | 0.050 g |
| Ultraviolet Absorbing Agent U-5 | | 0.30 g |
| Formalin Scavenger Cpd-H | | 0.40 g |
| Dye D-1 | | 0.15 g |
| Dye D-2 | | 0.050 g |
| Dye D-3 | | 0.10 g |
| Nineteenth Layer: Second Protective Layer | | |
| Colloidal Silver | silver amount: | 0.10 mg |
| Fine Grain Silver Iodobromide Emulsion (average grain size: 0.06 μm, AgI content: 1 mol %) | silver amount: | 0.10 g |
| Gelatin | | 0.40 g |
| Twentieth Layer: Third Protective Layer | | |
| Gelatin | | 0.40 g |
| Polymethyl Methacrylate (average particle size: 1.5 μm) | | 0.10 g |
| Copolymer of Methyl Methacrylate/Acrylic Acid in Proportion of 4/6 (average particle size: 1.5 μm) | | 0.10 g |
| Silicone Oil | | 0.030 g |
| Surfactant W-1 | | 3.0 mg |
| Surfactant W-2 | | 0.030 g |

Further, Additives F-1 to F-8 were added to every emulsion layer in addition to the above components. Moreover, gelatin hardener H-1 and surfactants W-3, W-4, W-5 and W-6 for coating and emulsifying were added to every layer in addition to the above components.

In addition, phenol, 1,2-benzisothiazolin-3-one, 2-phenoxyethanol, phenethyl alcohol, p-benzoic acid butyl ester were added as antibacterial and antifungal agents.

The silver iodobromide emulsions used in Sample No. 301 are as shown in Table 1.

TABLE 4

| Emulsion Name | Characteristics of Grain | Average Grain Size Corresponding to Sphere (μm) | Variation Coef ficient (%) | AgI Content (%) |
|---|---|---|---|---|
| A | Monodisperse tetra-decahedral grains | 0.28 | 16 | 4.0 |
| B | Monodisperse cubic internal latent image type grains | 0.30 | 10 | 4.0 |
| C | Monodisperse cubic grains | 0.38 | 10 | 5.0 |
| D | Monodisperse tabular grains, average aspect ratio: 4.0 | 0.68 | 8 | 2.0 |
| E | Monodisperse cubic grains | 0.20 | 17 | 4.0 |
| F | Monodisperse tetra-decahedral grains | 0.25 | 16 | 4.0 |
| G | Monodisperse cubic internal latent image type grains | 0.40 | 11 | 4.0 |
| H | Monodisperse cubic grains | 0.50 | 9 | 3.5 |
| I | Monodisperse tabular grains, average aspect ratio: 7.0 | 0.80 | 10 | 2.0 |
| J | Monodisperse cubic grains | 0.30 | 18 | 4.0 |
| K | Monodisperse tetra-decahedral grains | 0.45 | 17 | 4.0 |
| L | Monodisperse tabular grains, average aspect ratio: 5.0 | 0.55 | 10 | 2.0 |
| M | Monodisperse tabular grains, average aspect ratio: 8.0 | 0.70 | 13 | 2.0 |

TABLE 4-continued

| Emulsion Name | Characteristics of Grain | Average Grain Size Corresponding to Sphere (μm) | Variation Coef ficient (%) | AgI Content (%) |
|---|---|---|---|---|
| N | Monodisperse tabular grains, average aspect ratio: 6.0 | 1.00 | 10 | 1.5 |
| O | Monodisperse tabular grains, average aspect ratio: 9.0 | 1.20 | 15 | 1.5 |

TABLE 5

Spectral Sensitization of Emulsions A to I

| Emulsion Name | Sensitizing Dye Added | Addition Amount per mol of Silver Halide (g) |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |
| | S-3 | 0.25 |
| | S-8 | 0.010 |
| D | S-2 | 0.010 |
| | S-3 | 0.10 |
| | S-8 | 0.010 |
| E | S-4 | 0.50 |
| | S-5 | 0.10 |
| F | S-4 | 0.30 |
| | S-5 | 0.10 |
| G | S-4 | 0.25 |
| | S-5 | 0.08 |
| | S-9 | 0.05 |
| H | S-4 | 0.20 |
| | S-5 | 0.060 |
| | S-9 | 0.050 |
| I | S-4 | 0.30 |
| | S-5 | 0.070 |
| | S-9 | 0.10 |

TABLE 6

| Emulsion Name | Sensitizing Dye Added | Addition Amount per mol of Silver Halide (g) |
|---|---|---|
| J | S-6 | 0.050 |
| | S-7 | 0.20 |
| K | S-6 | 0.05 |
| | S-7 | 0.20 |
| L | S-6 | 0.060 |
| | S-7 | 0.22 |
| M | S-6 | 0.050 |
| | S-7 | 0.17 |
| N | S-6 | 0.040 |
| | S-7 | 0.15 |
| O | S-6 | 0.060 |
| | S-7 | 0.22 |

C-1

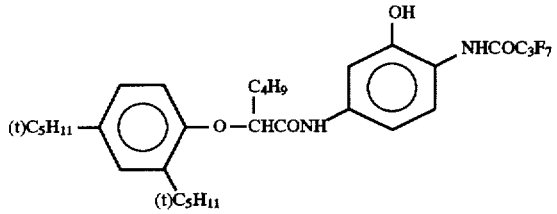

C-2

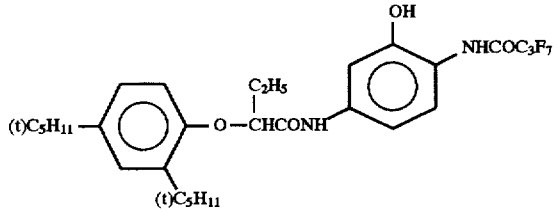

C-3

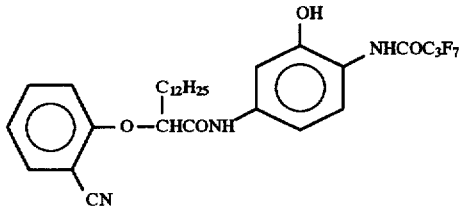

C-4

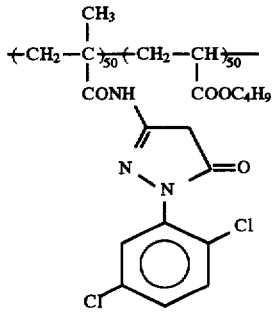

numerals indicate wt %
average molecular weight:
about 25,000

C-5

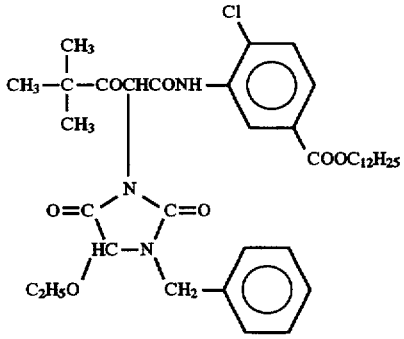

-continued
C-6
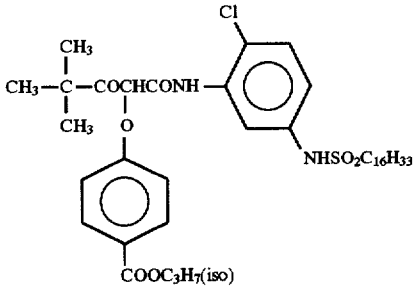
C-7
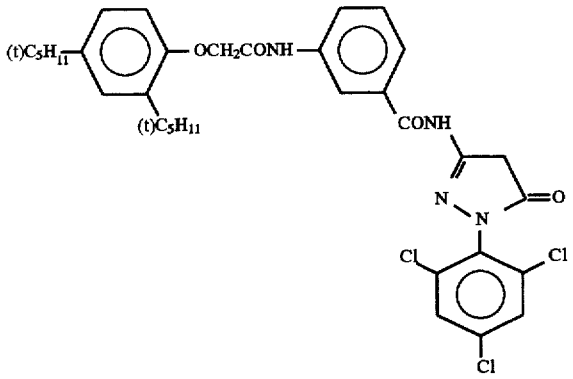
C-8
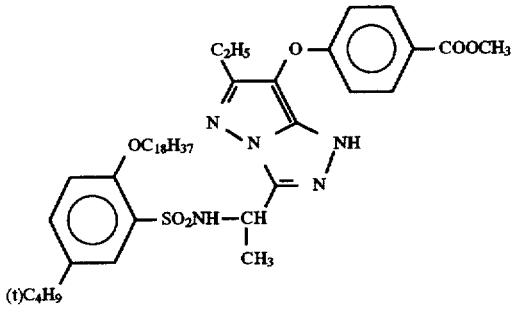
C-9
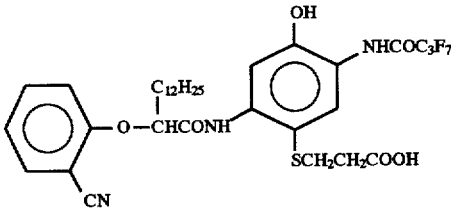
-continued
C-10
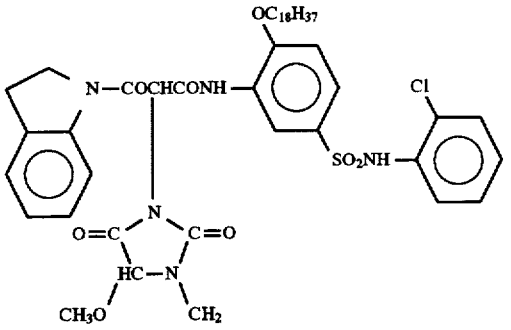
Oil-1
Dibutyl Phthalate
Oil-2
Tricresyl Phosphate
Oil-3
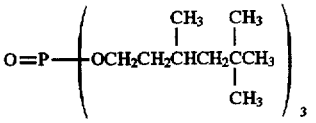
Cpd-A
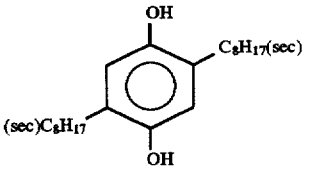
Cpd-B
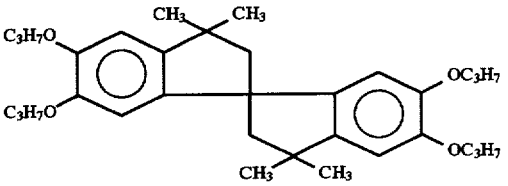
Cpd-C
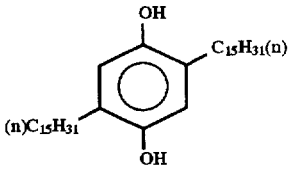
Cpd-D
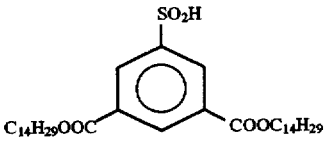

-continued
Cpd-E
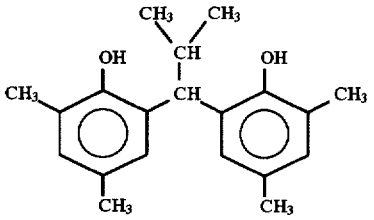
Cpd-F
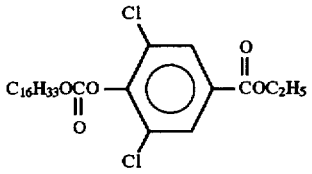
Cpd-H
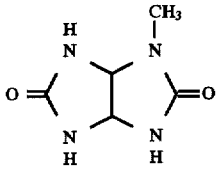
Cpd-I
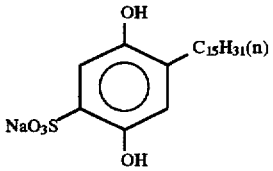
Cpd-J
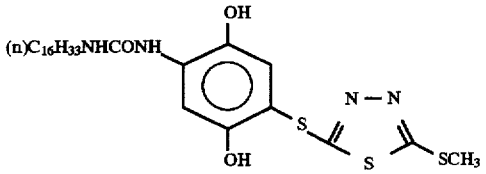
Cpd-K
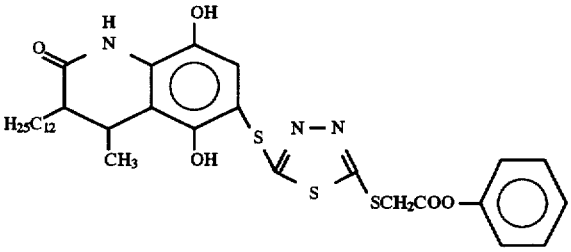
-continued
U-1
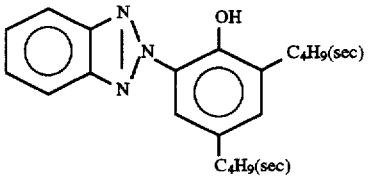
U-2
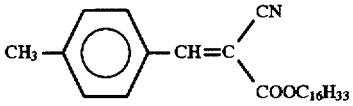
U-3
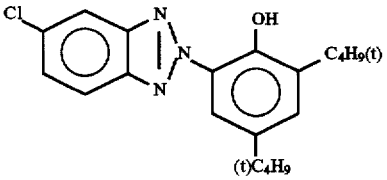
U-4
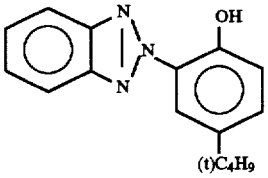
U-5
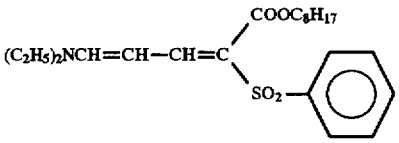
S-1
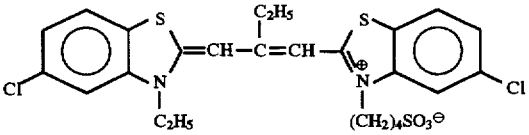
S-2
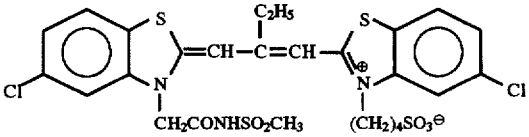

-continued
S-3
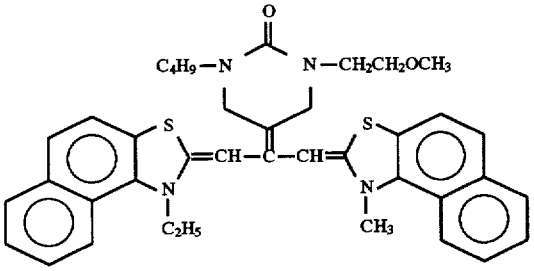
S-4
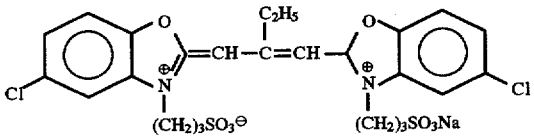
S-5
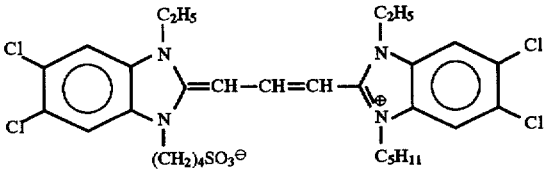
S-6
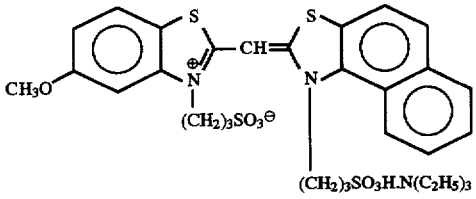
S-7
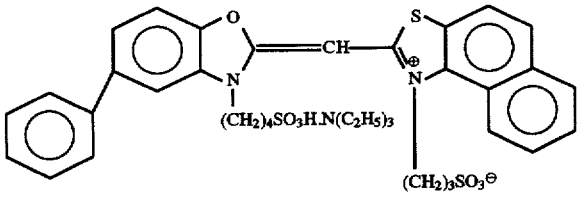
S-8
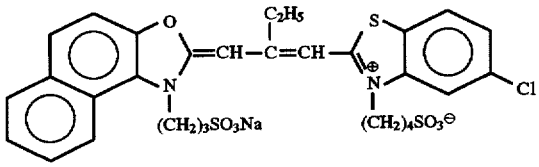
S-9
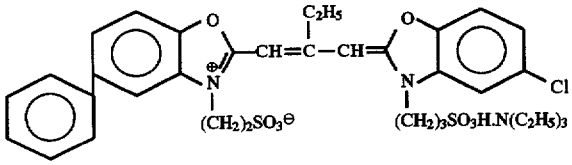
-continued
D-1
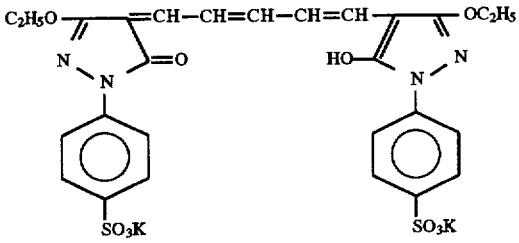
D-2
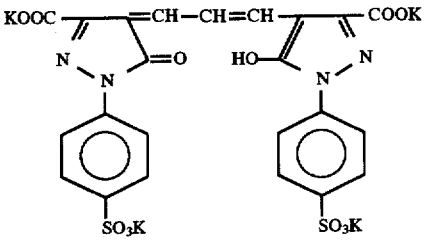
D-3
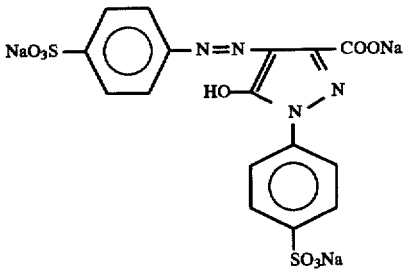
D-4
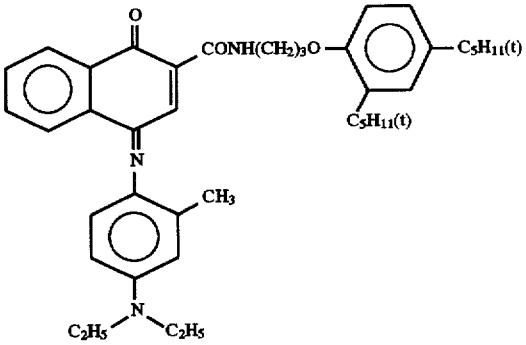
D-5
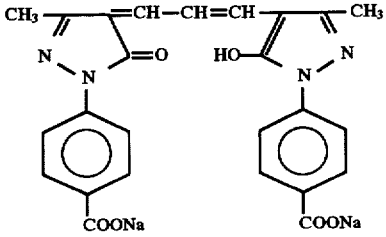

-continued
D-6
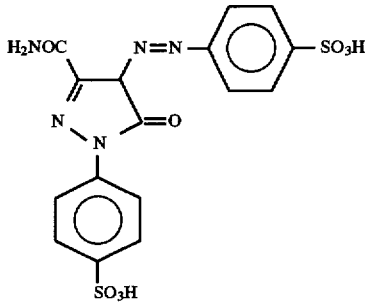
E-1
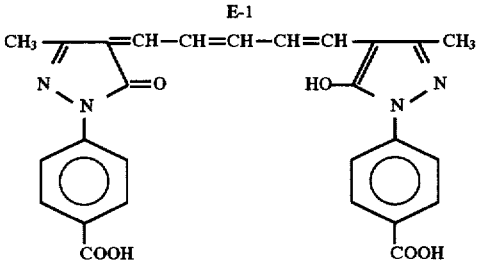
E-2
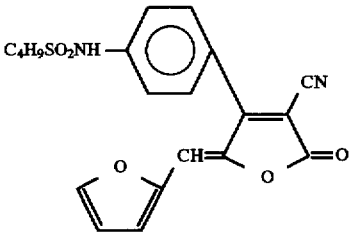
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2\overset{\oplus}{N}(CH_3)_3$
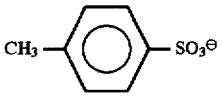
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
W-4
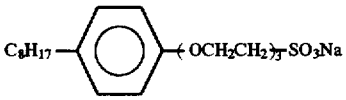
-continued
W-5
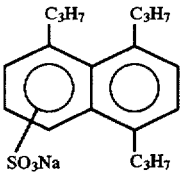
W-6
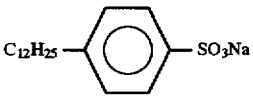
P-1
$(CH_2{-}CH)_n$ | $CONHC_4H_9(t)$
M-1
$(CH_2{-}CH)_n$ | $COOC_4H_9$
n = about 300 (average value) n = about 500 (average value)
F-1
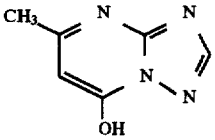
F-2
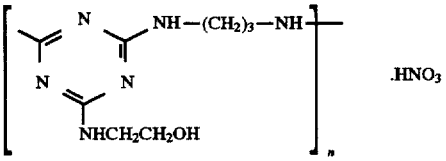
(n = 3–4)
F-3
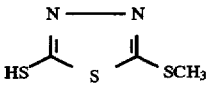
F-4
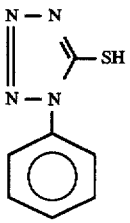
F-5
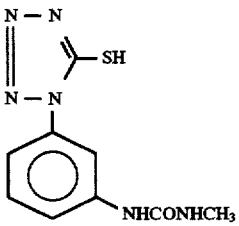

-continued

F-6

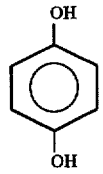

F-5

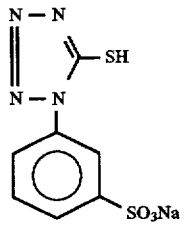

F-8

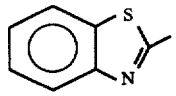

Preparation of Sample No. 302

Sample No. 302 was prepared in the same manner as the preparation of Sample No. 301 except for replacing Compound Cpd-A in the eighth layer and the thirteenth layer with the Compound H-3 according to the present invention in one time molar amount.

Preparation of Sample No. 303

Sample No. 303 was prepared in the same manner as the preparation of Sample No. 301 except for adding Compound A-53 according to the present invention to the ninth and tenth layers in amounts of 0.02 g/m$^2$ and 0.01 g/m$^2$, respectively.

Preparation of Sample No. 304

Sample No. 304 was prepared in the same manner as the preparation of Sample No. 302 except for adding Compound A-53 according to the present invention to the ninth and tenth layers in amounts of 0.02 g/m$^2$ and 0.01 g/m$^2$, respectively.

Preparation of Sample No. 305

Sample No. 305 was prepared in the same manner as the preparation of Sample No. 304 except for replacing Compound A-53 in the ninth and tenth layers with A-55 in one time molar amount.

Preparation of Sample No. 306

Sample No. 306 was prepared in the same manner as the preparation of Sample No. 302 except for adding Compound A-3 according to the present invention to the first to twentieth layers in total amount of 0.02 g/m$^2$.

Preparation of Sample No. 307

Sample No. 307 was prepared in the same manner as the preparation of Sample No. 304 except for adding Compound A-3 according to the present invention to the first to twentieth layers in total amount of 0.02 g/m$^2$.

Preparation of Sample Nos. 308 and 309

Sample Nos. 308 and 309 were prepared in the same manner as the preparation of Sample No. 304 except for replacing Compound H-3 in the eighth and thirteenth layers with the compounds shown in Table 7 in one time molar amount.

Evaluation of fluctuation in photographic characteristics from photographing until development processing After each sample was wedgewise exposed to white light, one sample was allowed to stand under conditions of 35° C., 60% RH for 14 days, and the other was stored in a freezer, then each sample was development processed according to the following processing step.

With each sample, the change in the density at the exposure amount of the magenta image of the sample stored in a freezer giving the density of minimum density+1.5 was compared, and (the density of the sample stored at 35° C.) minus (minimum density+1.5) was determined and this was taken as the criterion of the evaluation of fluctuation in photographic characteristics from photographing until development processing of a photographic material. The smaller the value, the smaller is the fluctuation in photographic characteristics from photographing until development processing.

Evaluation of pressure resistance

Under the conditions of 55% RH, one end of the sample was fixed and folded by revolving 180 degree at a folding speed of 360°/sec around a stainless steel pipe having a diameter of 10 mm with the emulsion coated surface inside. Ten seconds after folding, the sample was wedgewise exposed to white light, development processed according to the following processing step. The change in densities due to folding of unexposed part where the change in densities was most conspicuous was compared and evaluated by the following three grades.

⊙: Especially excellent

○: Excellent

Δ: Equal to control

Evaluation of fog with the lapse of time

One of each sample was allowed to stand at 55° C., 60% RH for 10 days and the other was stored in a freezer and subjected to the same exposure and development processing as above, and fog with the lapse of time was evaluated by the difference in maximum densities ($D_{max}$) of the green-sensitive layer. In the development of a color reversal photographic material, photographic fog appears as a reduction of maximum density.

$$(D_{max})=(D_{max} \text{ after raw stock})-(D_{max} \text{ after frozen stock})$$

The results obtained are shown in Table 7.

TABLE 7

| Sample No. | Compound in 9th and 10th Layers | Compound in 8th and 13th Layers | Fluctuation in Photographic Characteristics from Exposure to Development Processing | Change in Fog due to Storage | Pressure Resistance |
|---|---|---|---|---|---|
| 301 (Comparison) | — | Cpd-A | +0.11 | −0.21 | Control |
| 302 (Comparison) | — | H-3 | +0.06 | −0.14 | Δ |
| 303 (Comparison) | A-53 | Cpd-A | +0.05 | −0.16 | ○ |
| 304 (Invention) | A-53 | H-3 | +0.02 | −0.10 | ⊙ |

TABLE 7-continued

| Sample No. | Compound in 9th and 10th Layers | Compound in 8th and 13th Layers | Fluctuation in Photographic Characteristics from Exposure to Development Processing | Change in Fog due to Storage | Pressure Resistance |
|---|---|---|---|---|---|
| 305 (Invention) | A-55 | " | +0.03 | −0.10 | ◎ |
| 306 (Invention) | A-3 | " | +0.02 | −0.10 | ○ |
| 307 (Invention) | A-53<br>A-3 | " | +0.02 | −0.09 | ◎ |
| 308 (Invention) | A-53 | H-21 | +0.02 | −0.10 | ◎ |
| 309 (Invention) | A-53 | H-12 | +0.03 | −0.11 | ◎ |

As is apparent from the results in Table 7, fluctuation in photographic characteristics from exposure until development processing and the change in fog due to storage are small and pressure resistance is improved using the compound according to the present invention.

Development Processing Step

| Processing Step | Processing Time (min) | Processing Temperature (°C.) | Tank Capacity (liter) | Replenishment Rate (ml/m²) |
|---|---|---|---|---|
| First Development | 4 | 38 | 12 | 1,000 |
| First Washing | 45 | 38 | 2 | 2,200 |
| Reversal | 45 | 38 | 2 | 500 |
| Color Development | 4 | 38 | 12 | 1,000 |
| Bleaching | 3 | 38 | 4 | 200 |
| Fixing | 3 | 38 | 8 | 500 |
| Second Washing (1) | 1 | 38 | 2 | — |
| Second Washing (2) | 1 | 38 | 2 | 1,100 |
| Stabilization | 1 | 25 | 2 | 500 |
| Drying | 1 | 65 | — | — |

Replenishment of the second washing was conducted in a countercurrent system by introducing the replenisher into second washing (2) and introducing the overflow from second washing (2) into second washing (1).

The composition of each processing solution is as follows.

| | Tank Solution | Replenisher |
|---|---|---|
| First Developing Solution | | |
| Pentasodium Nitrilo-N,N,N-trimethylenephosphonate | 2.0 g | 3.0 g |
| Sodium Sulfite | 30 g | 40 g |
| Potassium Hydroquinone Monosulfonate | 30 g | 40 g |
| Potassium Carbonate | 40 g | 48 g |
| 1-Phenyl-4-methyl-4-hydroxylnethyl 3-pyrazolidone | 2.0 g | 3.5 g |
| Potassium Bromide | 2.5 g | 0 g |
| Potassiuin Thiocyanate | 1.2 g | 1.8 g |
| Potassium Iodide | 2.0 mg | — |
| Water to make | 1,000 ml | 1,000 ml |
| pH (adjusted with sulfuric acid or potassium hydroxide) | 10.00 | 10.20 |
| First Washing Water | | |
| Ethylenediaminetetramethylene-phosphonic Acid | 2.0 g | Replenisher equals tank solution |
| Disodium Phosphate | 5.0 g | |

-continued

| | Tank Solution | Replenisher |
|---|---|---|
| Water to make | 1,000 ml | |
| pH (adjusted with hydrochloric acid or sodium hydroxide) | 7.00 | |
| Reversal Solution | | |
| Pentasodium Nitrilo-N,N,N-trimethylenephosphonate | 3.0 g | Replenisher equals tank solution |
| Stannous Chloride.Dihydrate | 1.0 g | |
| p-Aminophenol | 0.1 g | |
| Sodium Hydroxide | 8 g | |
| Glacial Acetic Acid | 15 ml | |
| Water to make | 1,000 ml | |
| pH (adjusted with acetic acid or sodium hydroxide) | 6.00 | |
| Color Developing Solution | | |
| Pentasodium Nitrilo-N,N,N-trimethylenephosphonate | 2.0 g | 3.0 g |
| Sodium Sulfite | 7.0 g | 10.0 g |
| Trisodium Phosphate.Dodecahydrate | 40 g | 45 g |
| Potassium Bromide | 1.0 g | |
| Potassium Iodide | 90 mg | |
| Sodium Hydroxide | 3.0 g | 3.0 g |
| Citrazinic Acid | 1.5 g | 1.5 g |
| N-Ethyl-N-(β-methanesulfonamido-ethyl)-3-methyl-4-aminoaniline. 3/2 Sulfate.Monohydrate | 15 g | 20 g |
| 3,6-Dithiaoctane-1,8-diol | 1.0 g | 1.2 g |
| Water to make | 1,000 ml | 1,000 ml |
| pH (adjusted with sulfuric acid or potassium hydroxide) | 12.00 | 12.20 |
| Bleaching Solution | | |
| Ammonium 1,3-Diaminepropane-tetraacetato Ferrate Monohydrate | 5.0 g | 100 g |
| Potassium Bromide | 100 g | 200 g |
| Ammonium Nitrate | 10 g | 20 g |
| Acetic Acid (90%) | 60 g | 120 g |
| 3-Mercapto-1,2,4-triazole | 0.0005 mol | 0.0008 mol |
| Water to make | 1,000 ml | 1,000 ml |
| pH (adjusted with nitric acid or aqueous ammonia) | 4.5 | 4.0 |
| Fixing Solution | | |
| Disodium Ethylenediamine-tetraacetate Dihydrate | 10.0 g | 15.0 g |
| Ammonium Thiosulfate | 150 g | 200 g |
| Sodium Sulfite | 25.0 g | 30.0 g |
| Water to make | 1,000 ml | 1,000 ml |
| pH (adjusted with acetic acid or aqueous ammonia) | 6.60 | 6.80 |

Second Washing Water

City water was passed through a mixed bed column packed with an H-type strongly acidic cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 1.5 g/liter of sodium sulfate were added thereto. The pH of this washing water was in the range of from 6.5 to 7.5.

Stabilizing Solution

| | Tank Solution | Replenisher |
|---|---|---|
| 1-Hydroxymethyl-1,2,4-triazole | 2.3 g | Replenisher equals tank solution |
| Polyoxyethylene-p-monononylphenyl Ether (average polymerization degree: 10) | 0.3 g | |
| 1,2,4-Triazole | 2.0 g | |
| 1,4-Bis(1,2,4-triazol-1-ylmethyl) piperazine | 0.2 g | |
| 1,2-Benzisothiazolin-3-one | 0.05 g | |
| Water to make | 1,000 ml | |
| pH (adjusted with sodium hydroxide and acetic acid) | 6.5 | |

EXAMPLE 4

Sample Nos. 401, 402, 403, 404 and 405 were prepared in the same manner as the preparation of, respectively, Sample Nos. 101, 102, 104, 105 and 107 in Example 1, except for changing the coating amount of the magnetic substance of 60 mg/m$^2$ in respective magnetic layer in Example 1 to 100 mg/m$^2$.

Further, Sample Nos. 406, 407, 408, 409 and 410 were prepared in the same manner as the preparation of, respectively, Sample Nos. 101, 102, 104, 105 and 107, except for changing the coating amount of the magnetic substance of the magnetic layer to 0 mg/m$^2$.

The same aging test as in Example 1 was conducted with these samples and fog of the yellow image by aging was evaluated.

The results obtained are summarized in Table 8.

From the results in Table 8 and Table 3 in Example 1, it can be seen that fog of a photographic material due to storage increases by coating a magnetic substance but the fog due to storage largely decreases by the addition of the compound for use in the present invention to an emulsion layer.

The photographic material of the present invention has excellent effect of generating less fluctuation in photographic characteristics and the fog due to storage and further, improving pressure resistance.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one blue-sensitive silver halide emulsion layer, at least one green-sensitive silver halide emulsion layer, at least one red-sensitive silver halide emulsion layer and at least one light-insensitive layer, wherein one or more of the above layers contain at least one compound represented by formula (A-I), (A-II), (A-III), (A-IV) or (A-V) and one or more of the above layers contain at least one compound represented formula (H):

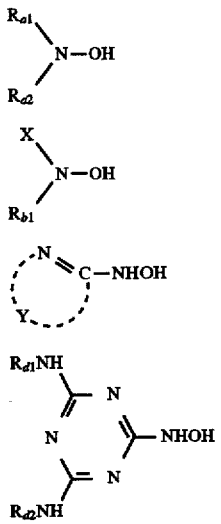

TABLE 8

| Sample No. | Coating Amount of Magnetic Substance | Compound for use in the Invention and Comparative Compound | | Fluctuation in Photographic Characteristics from Exposure to Development Processing | Change in Fog due to Storage | Pressure Resistance (fog density) |
|---|---|---|---|---|---|---|
| 401 (Comparison) | 100 | — | Cpd-1 | +0.16 | +0.20 | +0.31 |
| 402 (Comparison) | 100 | A-50 | Cpd-1 | +0.08 | +0.13 | +0.25 |
| 403 (Invention) | 100 | A-50 | H-3 | +0.02 | +0.02 | +0.12 |
| 404 (Comparison) | 100 | — | H-3 | +0.14 | +0.17 | #0.29 |
| 405 (Invention) | 100 | A-3 | H-3 | +0.02 | +0.03 | +0.12 |
| 406 (Comparison) | 0 | — | Cpd-1 | +0.11 | +0.09 | +0.18 |
| 407 (Comparison) | 0 | A-50 | Cpd-1 | +0.05 | +0.06 | +0.15 |
| 408 (Invention) | 0 | A-50 | H-3 | +0.01 | +0.01 | +0.08 |
| 409 (Comparison) | 0 | — | H-3 | +0.09 | +0.07 | +0.17 |
| 410 (Invention) | 0 | A-3 | H-3 | +0.02 | +0.02 | +0.08 |

-continued

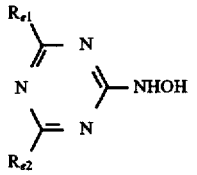

(A-V)

wherein $R_{a1}$ represents an alkyl group, an alkenyl group, an aryl group, an acyl group, an alkylsulfonyl group, an arylsulfonyl group, an alkylsulfinyl group, an arylsulfinyl group, a carbamoyl group, a sulfamoyl group, an alkoxy carbonyl group, or an aryloxycarbonyl group; $R_{a2}$ represents a hydrogen atom or a substituent described for $R_{a1}$, provided that when $R_{a1}$ represents an alkyl group, an alkenyl group or an aryl group, $R_{a2}$ represents an acyl group, an alkylsulfonyl group, an arylsulfonyl group, an alkylsulfinyl group, an arylsulfinyl group, a carbamoyl group, a sulfamoyl group, an alkoxycarbonyl group or an aryloxycarbonyl group, and $R_{a1}$ and $R_{a2}$ may be bonded with each other to form a 5- to 7-membered ring; X represents a heterocyclic group; $R_{b1}$ represents an alkyl group, an alkenyl group or an aryl group, and X and $R_{b1}$ may be bonded with each other to form a 5- to 7-membered ring; Y represents a nonmetallic atomic group necessary to form a 5-membered ring together with an —N=C— group, Y further represents a nonmetallic atomic group necessary to form a 6-membered ring together with an —N=C— group, and the terminal of Y bonded to the carbon atom of an —N=C— group represents a group selected from the group consisting of —N($R_{c1}$)—, —C($R_{c2}$)($R_{c3}$)—, —C($R_{c4}$)=, —O— and —S— (bonded to the carbon atom of an —N=C— group at the left side of each group); $R_{c1}$, $R_{c2}$, $R_{c3}$ and $R_{c4}$ each represents a hydrogen atom or a substituent; $R_{d1}$ and $R_{d2}$, which may be the same or different, each represents an alkyl group or an aryl group, provided that when $R_{d1}$ and $R_{d2}$ represent unsubstituted alkyl groups at the same time and yet $R_{d1}$ and $R_{d2}$ represent the same groups, $R_{d1}$ and $R_{d2}$ represent an alkyl group having 8 or more carbon atoms; $R_{e1}$ and $R_{e2}$, which may be the same or different, each represents a hydroxylamino group, a hydroxyl group, an amino group, an alkylamino group, an arylamino group, an alkoxyl group, an aryloxy group, an alkylthio group, an arylthio group, an alkyl group or an aryl group, provided that $R_{e1}$ and $R_{e2}$ do not represent —NH$R_{e3}$ (where $R_{e3}$ represents an alkyl group or an aryl group) at the same time;

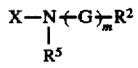

(H)

wherein X represents —N($R^1$)$R^3$, where $R^1$ represents a hydrogen atom, an aliphatic group, an aromatic group or a heterocyclic group, and $R^3$ represents a hydrogen atom or a group removed off under an alkaline condition; $R^2$ represents a hydrogen atom, an aliphatic group, an aromatic group, a heterocyclic group, a cyano group, a nitro group or a hydrazino group; X and $R^2$ may be linked to form a ring; $R^5$ represents a hydrogen atom, an alkyl group or a group removed off under an alkaline condition; two or more of formula (H) may be bonded at the $R^1$, $R^2$ or $R^5$ part to form an oligomer or polymer; G represents —CO—, —COCO—, —$SO_2$—, —SO—, —CON($R^6$)—, —COO—, —COCON($R^7$)—, —COCOO—, —PO($R^8$)—, —PO($R^8$)O—, —CS— or an iminomethylene group, where $R^6$ and $R^7$ represent a hydrogen atom, an alkyl group or an aryl group, and $R^8$ represents an alkyl group, an aryl group, an alkoxyl group or an aryloxy group; and m is 0, 1 or 2, and when m is 2, G may be the same or different.

2. The silver halide color photographic material as claimed in claim 1, wherein a magnetic layer containing a ferromagnetic powder is provided on the opposite side of the support on which the light-sensitive emulsion layer is provided.

3. The silver halide color photographic material as claimed in claim 1, wherein one of more of the layers contain at least one compound represented by formula (A-I), (A-II), (A-IV) or (A-V).

4. The silver halide color photographic material as claimed in claim 3, wherein one or more of the layers contain at least one compound represented by formula (A-I), (A-IV) or (A-V).

5. The silver halide color photographic material as claimed in claim 4, wherein one or more of the layers contain at least one compound represented by formula (A-I) or (A-V).

6. A silver halide color photographic material comprising a support having thereon at least one blue-sensitive silver halide emulsion layer, at least one green-sensitive silver halide emulsion layer, at least one red-sensitive silver halide emulsion layer and at least one light-insensitive layer, wherein one or more of the above layers contains at least one compound represented by formula (A-I), (A-II), (A-III) or (A-IV) and one or more of the above layers contains at least one compound represented by formula (H):

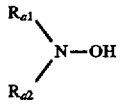

(A-I)

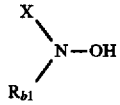

(A-II)

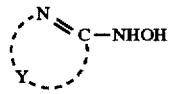

(A-III)

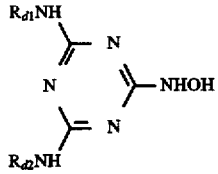

(A-IV)

wherein $R_{a1}$ represents an alkyl group, an alkenyl group, an aryl group, an acyl group, an alkylsulfonyl group, an arylsulfonyl group, an alkylsulfinyl group, an arylsulfinyl group, a carbamoyl group, a sulfamoyl group, an alkoxycarbonyl group, or an aryloxycarbonyl group; $R_{a2}$ represents a hydrogen atom or a substituent described for $R_{a1}$, provided that when $R_{a1}$ represents an alkyl group, an alkenyl group or an aryl group, $R_{a2}$ represents an acyl group, an alkylsulfonyl group, an arylsulfonyl group, an alkylsulfinyl group, an arylsulfinyl group, a carbamoyl group, a sulfamoyl group, an alkoxycarbonyl group or an aryloxycarbonyl group, and $R_{a1}$ and $R_{a2}$ my be bonded with each other to form a 5- to 7-membered ring; X represented a heterocyclic group; $R_{b1}$ represents an alkyl group, an alkenyl group or an aryl group, and X and $R_{b1}$ may be bonded with each other to form a 5- to 7-membered ring; Y represents a nonmetallic atomic group necessary to form a 5-membered ring together with an —N=C— group, Y further represents a nonmetallic atomic group necessary to form a 6-membered ring together with an —N=C— group, and the terminal of Y bonded to the carbon atom of an —N=C— group represents a group selected from the group consisting of —N($R_{c1}$)—, —C($R_{c2}$)($R_{c3}$)—, —C($R_{c4}$)=, —O— and —S— being bonded to the carbon atom of an —N=C— group at the left side of each group; $R_{c1}$, $R_{c2}$, $R_{c3}$ and $R_{c4}$ each represents a hydrogen atom or a substituent; $R_{d1}$ and $R_{d2}$, which may be the same or different, each represents an alkyl group or an aryl group, provided that when $R_{d1}$ and $R_{d2}$ represent unsubstituted alkyl groups at the same time and yet $R_{d1}$ and $R_{d2}$ represent the same groups, $R_{d1}$ and $R_{d2}$ represent an alkyl group having 8 or more carbon atoms;

$$X-\underset{\underset{R^5}{|}}{N}-(G)_m-R^2 \qquad (H)$$

wherein X represents —N($R^1$)$R^3$, where $R^1$ represents a hydrogen atom, an aliphatic group, an aromatic group or a heterocyclic group, and $R^3$ represents a hydrogen atom or a group removed off under an alkaline condition; $R^2$ represents a hydrogen atom, an aliphatic group, an aromatic group, a heterocyclic group, a cyano group, a nitro group or a hydrazino group; X and $R^2$ may be linked to form a ring; $R^5$ represents a hydrogen atom, an alkyl group or a group removed off under an alkaline condition; two or more of formula (H) may be bonded at the $R^1$, $R^2$ or $R^5$ part to form an oligomer or polymer; G represents —CO—, —COCO—, —$SO_2$—, —SO—, —CON($R^6$)—, —COO—, —COCON($R^7$)—, —COCOO—, —PO($R^8$)—, —PO($R^8$)O—, —CS— or an iminomethylene group, where $R^6$ and $R^7$ represent a hydrogen atom, an alkyl group or an aryl group, and $R^8$ represents an alkyl group, an aryl group, an alkoxyl group or an aryloxy group; and m is 0, 1 or 2, and when m is 2, G may be the same or different.

7. The silver halide color photographic material as claimed in claim 6, wherein the at least one compound represented by formula (A-I), (A-II), (A-III) or (A-IV) is represented by formula (A-I).

8. The silver halide color photographic material as claimed in claim 6, wherein the at least one compound represented by formula (A-I), (A-II), (A-III) or (A-IV) is represented by formula (A-II).

9. The silver halide color photographic material as claimed in claim 6, wherein the at least one compound represented by formula (A-I), (A-II), (A-III) or (A-IV) is represented by formula (A-III).

10. The silver halide color photographic material as claimed in claim 6, wherein the at least one compound represented by formula (A-I), (A-II), (A-III) or (A-IV) is represented by formula (A-IV).

* * * * *